US005424169A

United States Patent [19]

Ezoe et al.

[11] Patent Number: 5,424,169

[45] Date of Patent: Jun. 13, 1995

[54] SILVER HALIDE PHOTOGRAPHIC LIGHT-SENSITIVE MATERIAL

[75] Inventors: Toshihide Ezoe; Kazunobu Katoh; Kazumi Nii; Takashi Hoshimiya; Hisashi Okamura, all of Kanagawa, Japan

[73] Assignee: Fuji Photo Film Co., Ltd., Kanagawa, Japan

[21] Appl. No.: 131,731

[22] Filed: Oct. 5, 1993

[30] Foreign Application Priority Data

Oct. 6, 1992 [JP] Japan ..... 4-267332
Oct. 6, 1992 [JP] Japan ..... 4-267333

[51] Int. Cl.[6] ..... G03C 1/06

[52] U.S. Cl. ..... 430/264; 430/598; 430/223

[58] Field of Search ..... 430/264, 598, 223

[56] References Cited

U.S. PATENT DOCUMENTS

| | | | |
|---|---|---|---|
| 4,824,764 | 4/1989 | Inagaki et al. | 430/264 |
| 4,977,062 | 12/1990 | Yagihara et al. | 430/264 |
| 5,030,542 | 7/1991 | Nakamura et al. | 430/264 |
| 5,030,546 | 7/1991 | Takamuki et al. | 430/264 |
| 5,145,765 | 9/1992 | Okamura | 430/264 |
| 5,190,850 | 3/1993 | Sakai et al. | 430/264 |
| 5,196,291 | 3/1993 | Okada et al. | 430/264 |
| 5,204,214 | 4/1993 | Okamura et al. | 430/264 |
| 5,229,248 | 7/1993 | Sanpei et al. | 430/264 |

FOREIGN PATENT DOCUMENTS

| | | | |
|---|---|---|---|
| 0286062 | 10/1988 | European Pat. Off. | G03C 1/10 |
| 0398285 | 11/1990 | European Pat. Off. | G03C 1/04 |
| 0420005 | 4/1991 | European Pat. Off. . | |
| 0512420 | 11/1992 | European Pat. Off. . | |
| 2107074 | 4/1983 | United Kingdom | G03C 1/485 |

OTHER PUBLICATIONS

European Search Report.

*Primary Examiner*—Thomas R. Neville
*Attorney, Agent, or Firm*—Sughrue, Mion, Zinn, Macpeak & Seas

[57] ABSTRACT

There is disclosed a silver halide photographic light-sensitive material for plate making giving a hard gradation and having less variation in photographic performance due to fatigue of the developing solution. The silver halide photographic light-sensitive material has at least one silver halide emulsion layer and contains at least one of hydrazine compound represented by Formula (I) in the above emulsion layer or in another hydrophilic colloid layer. The light-sensitive material also contains at least one hydrazine compound represented by Formula (II) in the above emulsion layer or another hydrophilic colloid layers.

$$R_1\text{—NHNHCHO} \qquad \text{(I)}$$

$$R_1\text{—}\underset{\underset{A_1}{|}}{N}\text{—}\underset{\underset{A_2}{|}}{N}\text{—}G_1\text{—}R_2 \qquad \text{(II)}$$

The variables in these formulas are defined in the specification.

13 Claims, No Drawings

SILVER HALIDE PHOTOGRAPHIC LIGHT-SENSITIVE MATERIAL

FIELD OF THE INVENTION

The present invention relates to a silver halide photographic light-sensitive material and a method for forming a ultrahard gradation negative image therewith, specifically to a ultrahard gradation negative type photographic light-sensitive material which is suitable for use in a photographic printing plate making process.

BACKGROUND OF THE INVENTION

In the field of a photographic plate making, in order to meet the variety and complexity of printed matters, there is a demand for a photographic light-sensitive material having a good original reproducing performance, a stable processing solution, and simplified replenishing.

Particularly in a line photographing process, an original is made by applying a photocomposition character, a hand written character, an illustration, a halftonedotted photograph. Accordingly, images having different densities and line widths are mixed and present in the original, and there is a strong demand for a printing plate making camera, a photographic light-sensitive material, and an image forming method for treating these originals with a good reproducibility. Meanwhile, the scale up or scale down of a halftone dot photograph is broadly carried out during the plate making of a catalogue or a large size poster. In a plate making in which a scaled-up halftone dot is used, lines are toughened and a photographed dot gets vague. In the plate making in which a scaled-down halftone dot is used, the line number/inch ratio is larger than that of the original and the photographed dot gets fine. Accordingly, in order to maintain the reproducing performance of a halftone dot gradation, there is required an image forming method having a broader latitude.

The ultrahard gradation silver halide light-sensitive materials of a multi-layer structure having a layer containing a redox compound releasing a development inhibitor upon oxidation and a light-sensitive silver halide emulsion layer containing a hydrazine derivative are disclosed as a method for improving the reproducing performance of an original in JP-A-1-108215 (the term "JP-A" as used herein means an unexamined published Japanese patent application) and 1-240967.

However, light-sensitive materials including these combinations have a large variation in the photographic characteristics such as sensitivity and Dmax values due to fatigue of the developing solution and therefore an improvement therein is needed.

In a lithographic developing system, it is very difficult to maintain the activity of the developing solution constant, and the instability of image formation due to that feature used to be an important weakness. That requires an image forming system in which development is carried out in a processing solution having a good storage stability and with which an ultrahard gradation photographic characteristic can be obtained. As can be seen in U.S. Pat. Nos. 4,166,742, 4,168,977, 4,221,857, 4,224,401, 4,243,739, 4,272,606, and 4,311,781, there was proposed as one means to meet such requirements, a system in which a surface latent image type silver halide photographic light-sensitive material to which a specific hydrazine compound is added is processed in a developing solution with pH of 11.0 to 12.3 containing a sulfite preservative of 0.15 mole/liter or more and having a good storage stability to form a negative image of an ultrahard gradation having a $\gamma$ value exceeding 10. However, a large variation in photographic characteristics such as sensitivity and Dmax values due to fatigue of the developing solution still remains great so that it can not be neglected, and various devices have been tried for improvement therein.

Meanwhile, the use in combination of hydrazine compounds each having a different structure or quality is disclosed in JP-A-62-247351, JP-A-62-270948, JP-A-63-249838, JP-A-3-102343, and JP-A-3-152528, and Japanese patent applications 3-128212 and 3-246493.

In none of these methods, however, has compatibility of excellent original reproducing performance and processing stability yet been achieved.

SUMMARY OF THE INVENTION

Accordingly, an object of the present invention is to provide a light-sensitive material for printing plate making giving a hard gradation and having less variation in photographic performance due to the fatigue of the developing solution.

Further, another object of the present invention is to provide a light-sensitive material for plate making giving a hard gradation and having excellent original reproducing performance and storage stability.

These and other objects of the present invention have been achieved by a silver halide photographic light-sensitive material having at least one silver halide emulsion layer and containing at least one hydrazine compound represented by Formula (I) in the above emulsion layer or in another hydrophilic colloid layer. The light-sensitive material also contains at least one hydrazine compound represented by Formula (II) in the above emulsion layer or another hydrophilic colloid layer.

Further, the above objects of the present invention have also been achieved by a silver halide photographic light-sensitive material having at least one silver halide emulsion layer containing at least one hydrazine compound represented by Formula (I) and a hydrophilic colloid layer containing a redox compound capable of releasing a development inhibitor by oxidation. The hydrophilic colloid layer is different from the above light-sensitive silver halide layer. This light-sensitive material also contains at least one hydrazine compound represented by Formula (II) in the above emulsion layer or in another hydrophilic colloid layer:

$$R_1\text{-NHNHCHO} \qquad \text{(I)}$$

wherein $R_1$ represents an aliphatic group or an aromatic group and may or may not be substituted;

$$R_1-\underset{\underset{A_1}{|}}{N}-\underset{\underset{A_2}{|}}{N}-G_1-R_2 \qquad \text{(II)}$$

wherein $R_1$ represents an aliphatic group or an aromatic group; $R_2$ represents an alkyl group, an aryl group, an alkoxy group, an aryloxy group, an amino group, or a hydrazino group, any of which may or may not be substituted; $G_1$ represents —CO—, —$SO_2$—, —SO—, —P(=O)$R_3$—, —C(=O)C(=O)—, a thiocarbonyl group, or an iminomethylene group; both $A_1$ and $A_2$ represent a hydrogen atom, or one of them represents a hydrogen atom and the other represents a substituted or unsubstituted alkylsulfonyl group, a substituted or unsubstituted arylsulfonyl group, or a substituted or unsubstituted acyl group; and $R_3$ is selected from the same groups as those defined for $R_2$ and a hydrogen atom and may be the same as or different from $R_2$.

DETAILED DESCRIPTION OF THE INVENTION

The compound represented by Formula (I) is described below in detail.

In Formula (I), the aliphatic group represented by $R_1$ preferably has a carbon number of 1 to 30 and is particularly preferably a linear, branched or cyclic alkyl group having a carbon number of 1 to 20. The branched alkyl group may be cyclized so that a saturated hetrocycle containing one or more hetero atoms therein may be formed. Further, this alkyl group may have a substituent such as an aryl group, an alkoxy group, a sulfoxy group, a sulfonamide group, and a carbonamide group. There can be mentioned as examples thereof, t-butyl, n-octyl, t-octyl, cyclohexyl, pyrrolidyl, imidazolyl, tetrahydrofuryl, and morpholino groups.

In Formula (I), the aromatic group represented by $R_1$ is a monocyclic or dicyclic aryl group or an unsaturated heterocyclic group. The unsaturated heterocyclic group may be condensed with a monocyclic or dicyclic aryl group to form a heteroaryl group. These aryl groups include, for example, a benzene ring, a naphthalene ring, a pyridine ring, a pyrimidine ring, an imidazole ring, a pyrazole ring, a quinoline ring, an isoquinoline ring, a benzimidazole ring, a thiazole ring, and a benzothiazole ring. Among them, the group containing a benzene ring is preferred.

The aryl group is particularly preferred as $R_1$.

The aryl group or aromatic group represented by $R_1$ may have a substituent.

Representative substituents include a linear, branched or cyclic alkyl group (which has preferably a carbon number of 1 to 20), an aralkyl group (which has preferably a carbon number of 1 to 3 in an alkyl moiety and is monocyclic or dicyclic), an alkoxy group (which has preferably a carbon number of 1 to 20), a substituted amino group (preferably an amino group substituted with an alkyl group having the carbon number of 1 to 20), an acylamino group (which has preferably a carbon number of 2 to 30), a sulfonamide group (which has preferably a carbon number of 1 to 30), and a ureido group (which has preferably a carbon number of 1 to 30).

$R_1$ in Formula (I) may have a ballast group therein which is conventionally used in an immobile photographic additive. The ballast group is a group which has a carbon number of 8 or more and is comparatively inactive with respect to photographic characteristics, and can be selected from, for example, an alkyl group, an alkoxy group, a phenyl group, an alkylphenyl group, a phenoxy group, and an alkylphenoxy group.

In $R_1$ of Formula (I), a group promoting adsorption on to the surface of a silver halide grain may be incorporated thereinto. The groups described in U.S. Pat. No. 4,385,108 can be mentioned as such adsorblng groups.

The synthesis methods for these compounds are described in JP-A-53-20921, JP-A-53-20922, JP-A-53-66732, and JP-A-53-20318, and U.S. Pat. Nos. 4,224,401, 4,168,977 and 4,323,643.

The concrete examples of the compound represented by Formula (I) are shown below but the present invention will not be limited to the following compounds.

(I-1)

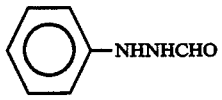

(I-2)

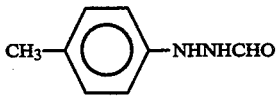

(I-3)

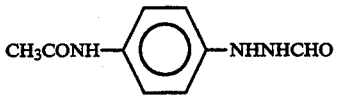

(I-4)

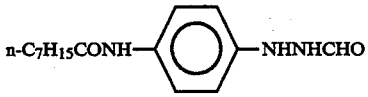

(I-5)

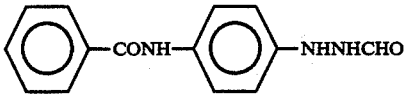

(I-6)

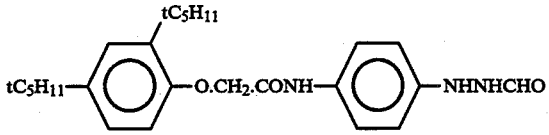

-continued
(I-7)
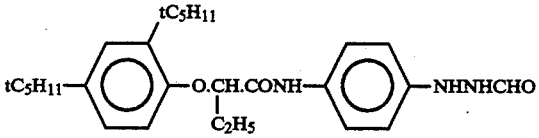
(I-8)
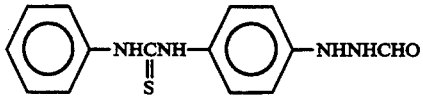
(I-9)
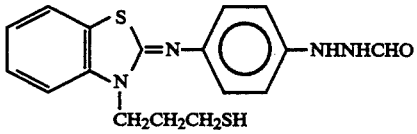
(I-10)
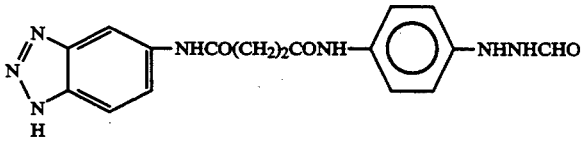
(I-11)
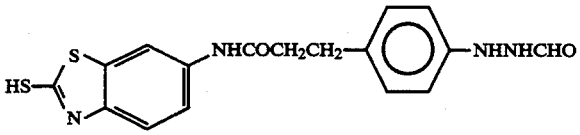
(I-12)
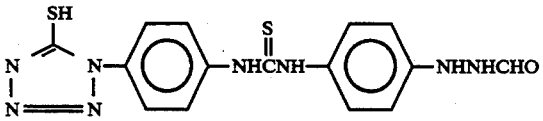
(I-13)
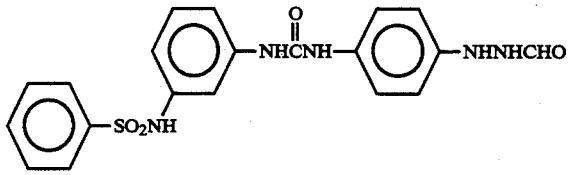
(I-14)
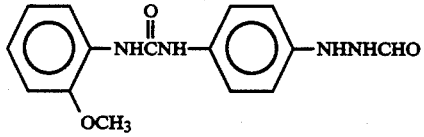
(I-15)
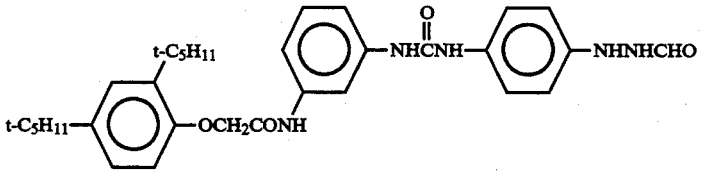
(I-16)
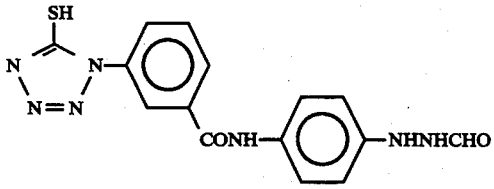

-continued
(I-17)
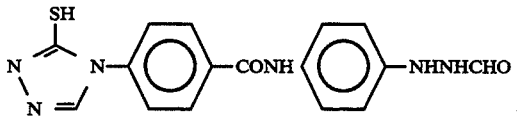
(I-18)
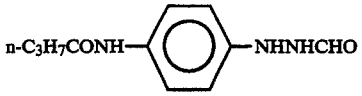
(I-19)
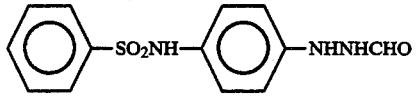
(I-20)
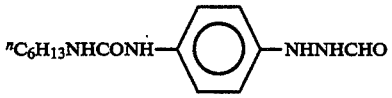
(I-21)
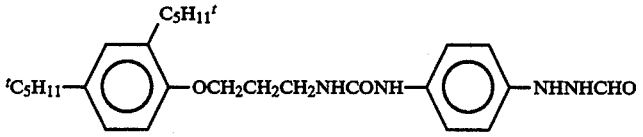
(I-22)
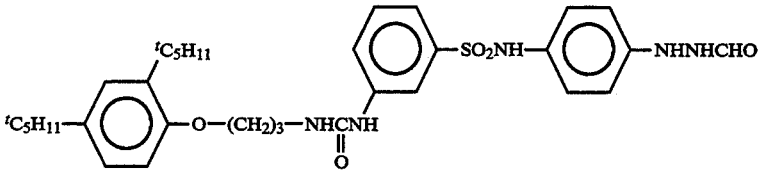
(I-23)
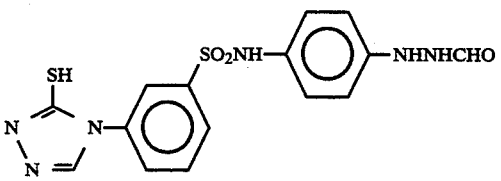
(I-24)
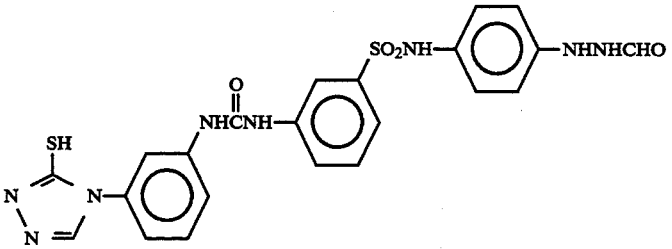
(I-25)
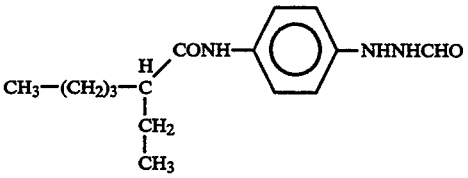

-continued (I-26)

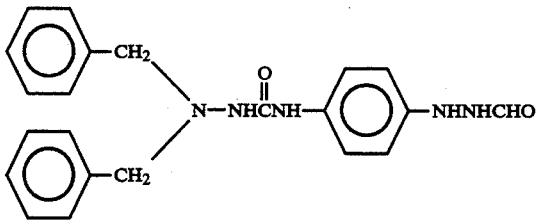

(I-27)

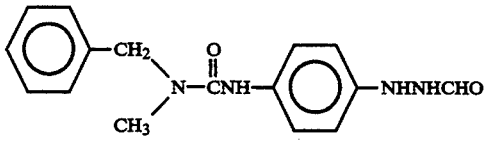

(I-28)

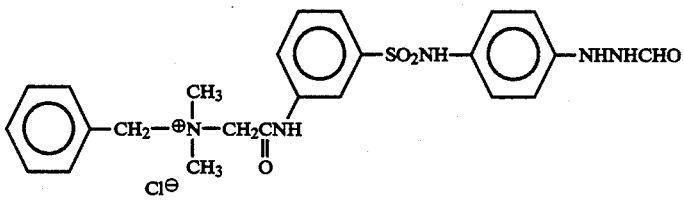

(I-29)

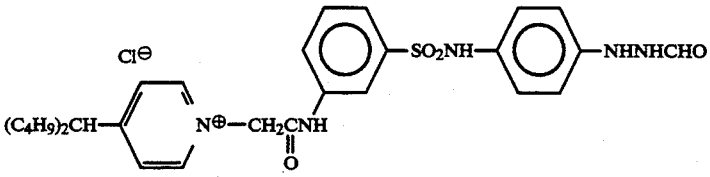

Next, the compounds represented by Formula (II) are explained below in detail.

In Formula (II), the aliphatic group represented by $R_1$ preferably has a carbon number of 1 to 30 and particularly is a linear, branched or cyclic alkyl group having the carbon number of 1 to 20. This alkyl group may have a substituent.

In Formula (II), the aromatic group represented by $R_1$ is a monocyclic or dicyclic aryl group or unsaturated heterocyclic group, wherein the unsaturated heterocyclic group may be condensed with an aryl group.

Preferred as $R_1$ is an aryl group, particularly preferably an aryl group containing a benzene ring.

The aliphatic group or aromatic group represented by $R_1$ may be substituted, and there can be mentioned as representative substituents therefor, an alkyl group, an aralkyl group, an alkenyl group, an alkynyl group, an alkoxy group, an aryl group, a substituted amino group, a ureido group, a urethane group, an aryloxy group, a sulfamoyl group, a carbamoyl group, an alkyl- or arylthio group, an alkyl- or arylsulfonyl group, an alkyl- or arylsulfinyl group, a hydroxy group, a halogen atom, a cyano group, a sulfo group, an aryloxycarbonyl group, an acyl group, an alkoxycarbonyl group, an acyloxy group, a carbonamido group, a sulfonamido group, a carboxyl group, a phosphoric amido group, a diacylamino group, an imido group, and $R_4$—NH-CON($R_5$)—CO— ($R_4$ and $R_5$ are selected from the same groups as those defined for $R_2$ and a hydrogen atom and may be the same as or different from each other). The preferred substituents are an alkyl group (having preferably a carbon number of 1 to 20), an aralkyl group (having preferably a carbon number of 7 to 30), an alkoxy group (having preferably a carbon number of 1 to 20), a substituted amino group (an amino group substituted with an alkyl group having preferably a carbon number of 1 to 20), an acylamino group (having preferably a carbon number of 2 to 30), a sulfonamido group (having preferably a carbon number of 1 to 30), a ureido group (having preferably a carbon number of 1 to 30), and a phosphoric amido group (having preferably a carbon number of 1 to 30). These groups may further be substituted.

The alkyl group represented by $R_2$ in Formula (II) is preferably an alkyl group having a carbon number of 1 to 4, and the aryl group represented by $R_2$ is preferably a monocyclic or dicyclic aryl group (for example, an aryl group containing a benzene ring). The alkoxy group represented by $R_2$ is preferably an alkoxy group having a carbon number of 1 to 4, such as ethoxy group and butoxy group, the aryloxy group represented by $R_2$ is preferably phenoxy group, the amino group represented by $R_2$ is preferably diethylamino group and dimethylamino group, and the hydrazino group represented by $R_2$ is preferably hydrazino group.

In the case where $G_1$ is a carbonyl group, among the groups represented by $R_2$, preferred are an alkyl group (for example, methyl, methoxymethyl, trifluoromethyl, 3-hydroxypropyl, 3-methanesulfonamidopropyl, and phenylsulfonylmethyl), an aralkyl group (for example, o-hydroxybenzyl), and an aryl group (for example, phenyl, 3,5-dichlorophenyl, o-methanesulfonamidophenyl, 4-methanesulfonylphenyl, and 2-hydoxymethylphenyl). The alkyl group is particularly preferred, and the alkoxyalkyl group is most preferred.

$R_2$ may be substituted and the substituents mentioned for $R_1$ can be applied.

The carbonyl group is the most preferred as $G_1$ in Formula (II).

Also, $R_2$ may permit the moiety $G_1$—$R_2$ to split off from the residue of a molecule and may cause a cyclization reaction in which a cyclic structure containing the atoms in the moiety —$G_1$—$R_2$ is formed, and the compounds described in, for example, JP-A-63-29751 can be mentioned as examples thereof.

A hydrogen atom is the most preferred as $A_1$ and $A_2$.

$R_1$ or $R_2$ in Formula (II) may have a ballast group or a polymer incorporated thereinto, which is conventionally used for an immobile photographic additive. The ballast group is a group which has a carbon number of 8 or more and is comparatively inactive with respect to photographic characteristics. It can be selected from, for example, an alkyl group, an alkoxy group, a phenyl group, an alkylphenyl group, a phenoxy group, and an alkylphenoxy group. Also, the compounds described in JP-A-1-100530 can be mentioned as the polymer.

In $R_1$ or $R_2$ in Formula (II), a group promoting adsorption to the surface of a silver halide grain may be incorporated thereinto. There can be mentioned as such an adsorption promoting group, the groups described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201,049, JP-A-61-170733, JP-A-61-270744, JP-A-62-948, JP-A-63-234244, JP-A-63-234245, and JP-A-63-234246, such as a thiourea group, a heterocyclic thioamido group, a mercapto heterocyclic group, and a triazole group.

$R_2$ in Formula (II) does not include a group having a development inhibiting effect. The group having a development inhibiting effect includes that having a hetero atom to form a development inhibiting agent via the hetero atom, and is disclosed, for example, in T. H. James, *The Theory of the Photographic Process*, 3rd edition, pp 344 to 346, published by Macmillan Co., Ltd. (1966).

The synthesis methods for the compounds represented by Formula (II) are described, for example, in U.S. Pat. Nos. 4,977,062 and 4,824,764. Examples of the compounds represented by Formula (II) are shown below but the present invention will not be limited to the following compounds.

(II-1)

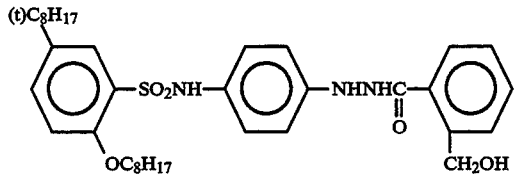

(II-2)

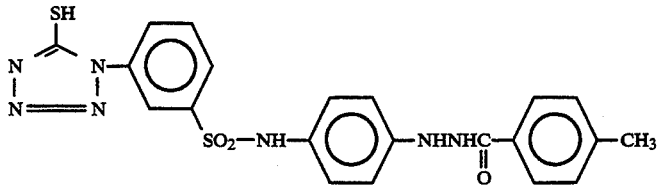

(II-3)

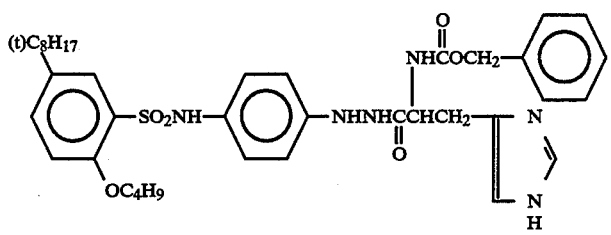

(II-4)

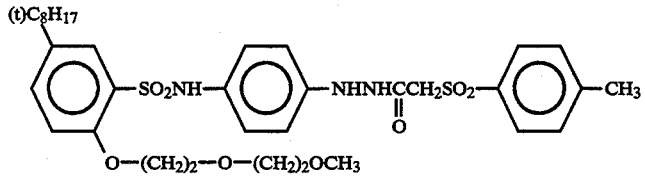

(II-5)

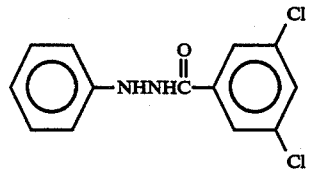

(II-6)

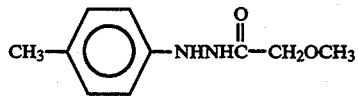

-continued
(II-7)
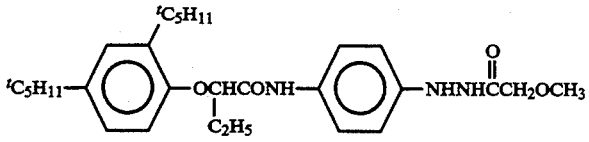
(II-8)
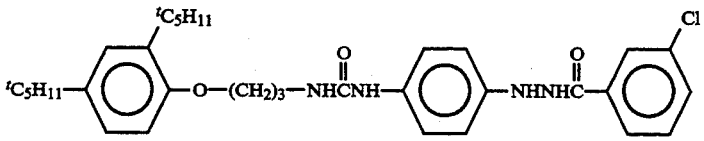
(II-9)
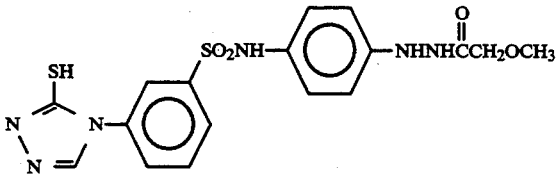
(II-10)
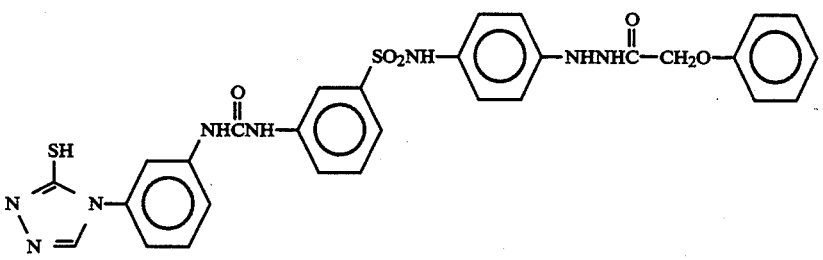
(II-11)
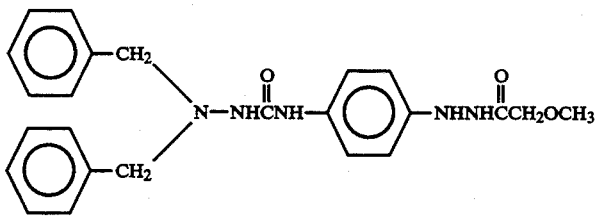
(II-12)
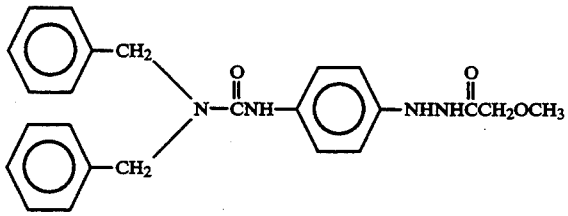
(II-13)
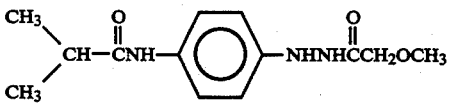
(II-14)
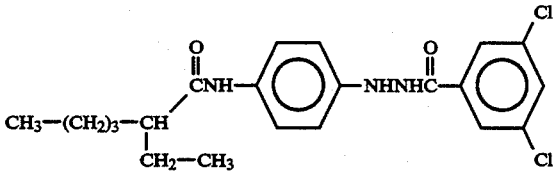
(II-15)
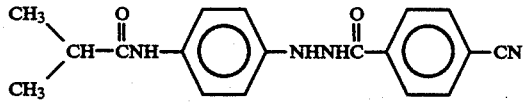

-continued (II-16)

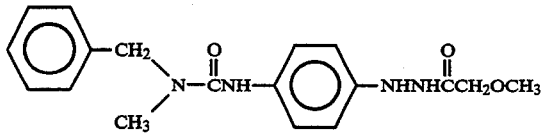

(II-17)

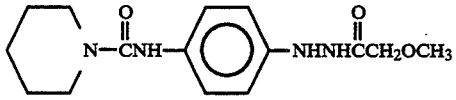

(II-18)

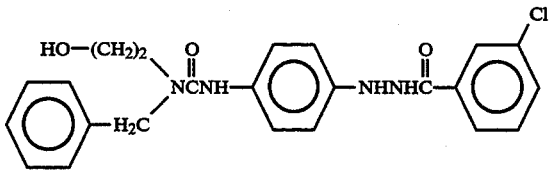

(II-19)

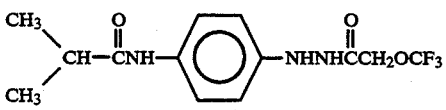

(II-20)

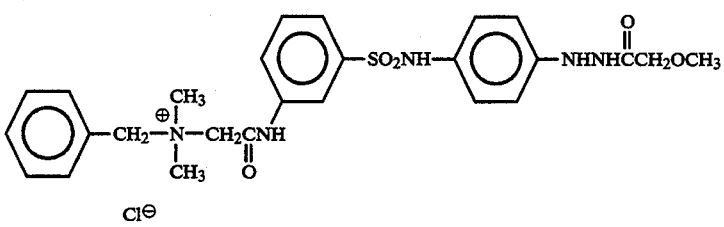

(II-21)

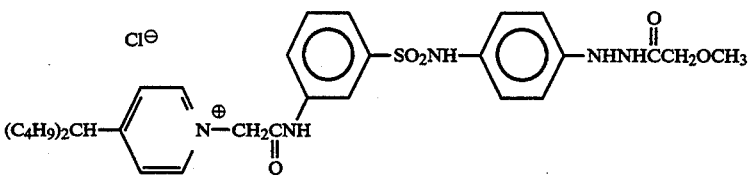

In addition to the above compounds, there can be used as the compound represented by Formula (II) in the present invention, the non-formylhydrazine derivatives among the compounds described in *Research Disclosure* Item 23516 (November 1983), p. 346 and the publications cited therein, and in addition, U.S. Pat. Nos. 4,080,207, 4,269,929, 4,276,364, 4,278,748, 4,385,108, 4,459,347, 4,560,638, and 4,478,928, British Patent 2,011,3915, JP-A-60-179734, JP-A-62-270948, JP-A-63-29751, JP-A-61-170733, JP-A-61-270744, and JP-A-62-270948, EP 217,310, EP 356,898, U.S. Patent 4,686,167, and JP-A-62-178246, JP-A-63-32538, JP-A-53-104047, JP-A-63-121838, JP-A-63-129337, JP-A-63-223744, JP-A-63-234244, JP-A-63-234245, JP-A-63-234246, JP-A-63-294552, JP-A-63-306438, JP-A-1-100530, JP-A-1-105941, JP-A-1-105943, JP-A-64-10233, JP-A-1-90439, JP-A-1-276128, JP-A-1-280747, JP-A-1-283548, JP-A-1-283549, JP-A-1-285940, JP-A-63-147339, JP-A-63-179760, JP-A-63-229163, JP-A-1-18377, JP-A-1-18378, JP-A-1-18379, JP-A-1-15755, JP-A-1-16814, JP-A-1-40792, JP-A-1-42615, JP-A-1-42616, JP-A-1-123693, and JP-A-1-126284.

The hydrazine derivative represented by Formula (I) and the hydrazine derivative represented by Formula (II) in the present invention each are added to a silver halide emulsion layer in a preferred amount of $1\times10^{-6}$ to $5\times10^{-2}$ mole per mole of silver halide, and in a most preferred amount of $1\times10^{-5}$ to $2\times10^{-2}$ mole per mole of silver halide.

The combined use ratio (mole ratio) of the hydrazine derivative represented by Formula (I) and the hydrazine derivative represented by Formula (II) in the present invention is preferably 20:1 to 1:20, more preferably 1:5 to 5:1, and most preferably 1:2 to 2:1.

The hydrazine derivatives of the present invention can be dissolved in a suitable water miscible organic solvent, for example, alcohols (methanol, ethanol, propanol, and fluorinated alcohol), ketones (acetone and methyl ethyl ketone), dimethylformamide, dimethylsulfoxide, and methyl cellosolve, before addition to the photographic material.

Further, the hydrazine derivatives can be dissolved with the aid of an oil such as dibutyl phthalate, tricresyl phosphate, glyceryl triacetate, and diethyl phthalate, and an auxiliary solvent such as ethyl acetate and cyclohexanone to mechanically prepare the emulsified dispersions thereof by well known dispersing methods to use them as well. Alternatively, powders of the hydrazine derivatives can be dispersed in water by a method known as a solid matter dispersing method with a ball mill, a colloid mill or a supersonic wave to use them as well.

The redox compounds used in the present invention are capable of releasing a development inhibitor by oxidation due to the oxidation product of a developing agent. The redox compounds are explained below.

The redox group in the redox compound is preferably selected from among hydroquinones, catechols, a naphthohydroquinone group, aminophenols, pyrazolidones, hydrazines, hydroxylamines, and reductons, and it is more preferably a hydrazine.

Hydrazines used as the redox compound capable of releasing a development inhibitor by oxidation are represented preferably by one of the following Formulas (R-1), (R-2) and (R-3). The compounds represented by Formula (R-1) are particularly preferred:

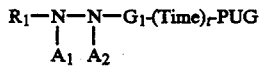
(R-1)

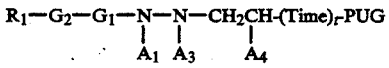
(R-2)

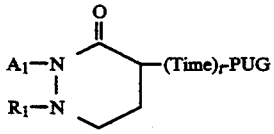
(R-3)

In these formulas, $R_1$ represents an aliphatic group or an aromatic group. $G_1$ represents —CO—, —COCO—, —CS—, —C(=$NG_2R_2$)—, —SO—, —$SO_2$—, or —P(O)($G_2R_2$)—. $G_2$ represents a mere bond, —O—, —S— or —N($R_2$)—, and $R_2$ represents the same group as that defined for $R_1$ or a hydrogen atom. In the case where a plurality of $R_2$ groups is present in the redox compound, they may be the same or different.

$A_1$ and $A_2$ each represents a hydrogen atom, an alkylsulfonyl group, an arylsulfonyl group, or an acyl group and may or may not be substituted. In Formula (R-1), at least one of $A_1$ and $A_2$ is a hydrogen atom. $A_3$ is synonymous with $A_1$ or represents —$CH_2CH(A_4)$-(Time)$_t$—PUG. $A_4$ represents a nitro group, a cyano group, a carboxyl group, a sulfonyl group, or —$G_1$—$G_2$—$R_1$ (in this case, the two —$G_1$—$G_2$—$R_1$ groups in the redox compound may be the same or different).

Time represents a divalent linkage group and t represents 0 or 1. PUG represents a development inhibitor.

Formulas (R-1), (R-2) and (R-3) are explained below in more detail.

In Formulas (R-1), (R-2) and (R-3), the aliphatic group represented by $R_1$ preferably has a carbon number of 1 to 30 and particularly is a linear, branched or cyclic alkyl group having preferably a carbon number of 1 to 20. This alkyl group may have a substituent.

In Formulas (R-1), (R-2) and (R-3), the aromatic group represented by $R_1$ is a monocyclic or dicyclic aryl group or unsaturated heterocyclic group. The unsaturated heterocyclic group may be condensed with an aryl group to form a heteroaryl group. It includes, for example, a benzene ring, a naphthalene ring, a pyridine ring, a quinoline ring, and an isoquinoline ring. Among them, the group containing a benzene ring is preferred.

The aryl group is particularly preferred as $R_1$.

The aliphatic group or aromatic group represented by $R_1$ may be substituted. There can be mentioned as representative substituents therefor, an alkyl group, an aralkyl group, an alkenyl group, an alkynyl group, an alkoxy group, an aryl group, a substituted amino group, a ureido group, a urethane group, an aryloxy group, a sulfamoyl group, a carbamoyl group, an alkylthio group, an arylthio group, a sulfonyl group, a sulfinyl group, a hydroxy group, a halogen atom, a cyano group, a sulfo group, an aryloxycarbonyl group, an acyl group, an alkoxycarbonyl group, an acyloxy group, a carbonamido group, a sulfonamido group, a carboxyl group, and a phosphoric acid amido group. The preferred substituents are linear, branched or cyclic alkyl groups (having preferably a carbon number of 1 to 20), an aralkyl group (having preferably a carbon number of 7 to 30), an alkoxy group (having preferably a carbon number of 1 to 30), a substituted amino group (an amino group substituted with an alkyl group having preferably a carbon number of 1 to 30), an acylamino group (having preferably a carbon number of 2 to 40), a sulfonamide group (having preferably a carbon number of 1 to 40), a ureido group (having preferably a carbon number of 1 to 40), and a phosphoric amido group (having preferably a carbon number of 1 to 40).

Preferred as $G_1$ in Formulas (R-1), (R-2) and (R-3) is —CO— and —$SO_2$—, and —CO— is most preferred.

A hydrogen atom is preferred as $A_1$ and $A_2$. A hydrogen atom or —$CH_2CH(A_4)$-(Time)$_t$—PUG is preferred as $A_3$.

In Formulas (R-1), (R-2) and (R-3), Time represents a divalent linkage group and may have a timing controlling function.

The divalent linkage group represented by Time represents a group releasing PUG from Time-PUG after Time-PUG is released from the oxidation product of an oxidation-reduction major nucleus through a reaction of one or more stages.

There can be mentioned as the divalent linkage groups represented by Time, for example, the groups releasing PUG by the intramolecular cyclization reaction of a p-nitrophenoxy derivative, described in U.S. Pat. No. 4,248,962 (JP-A-54-145135); the groups releasing PUG by the intramolecular cyclization reaction after a ring cleavage, described in U.S. Pat. Nos. 4,310,612 (JP-A-55-5330) and 4,358,525; the groups releasing PUG accompanied with the formation of acid anhydride generated by the intramolecular cyclization reaction of a carboxyl group in succinic acid monoester or the derivatives thereof, described in U.S. Pat. Nos. 4,330,617, 4,446,216, and 4,483,919, and JP-A-59-121328; the groups releasing PUG by forming quinomonomethane or the derivatives thereof upon an electron transfer via a double bond with which an aryloxy group or a heterocyclic oxy group is conjugated, described in U.S. Pat. Nos. 4,409,323 and 4,421,845, Research Disclosure No. 21,228 (December 1981), U.S. Pat. No. 4,416,977 (JP-A-57-135944), and JP-A-58-209736 and JP-A-58-209738; the groups releasing PUG from the γ-position of enamine upon an electron transfer at a site having an enamine structure in a nitrogen-containing heterocycle, described in U.S. Pat. No. 4,420,554 (JP-A-57-136640), and JP-A-57-135945, JP-A-57-188035, JP-A-58-98728, and JP-A-58-209737; the groups releasing PUG by the intramolecular cyclization reaction of an oxyl group formed by an electron transfer to a carbonyl group conjugated with a nitrogen atom in a nitrogen-containing heterocycle, described in JP-A-57-56837; the groups releasing PUG accompanying the formation of aldehydes, described in U.S. Pat. No. 4,146,396 (JP-A-52-90932), JP-A-59-93442, JP-A-59-75475, JP-A-60-249148, and JP-A-60-249149; the groups releasing PUG accompanying the decarboxylation in a carboxyl group, described in JP-A-51-146828, JP-A-57-179842, and JP-A-59-104641; the groups having the structure of —O—COOR$_a$R$_b$—PUG (R$_a$ and R$_b$ each represents a monovalent group) and releasing PUG accompanying the formation of aldehydes following decarboxylation; the groups releasing PUG accompanying the formation of isocyanate, described in JP-A-60-7429; and the groups releasing PUG by a coupling reaction with the oxidation product of a color developing agent, described in U.S. Pat. No. 4,438,193.

Examples of these divalent linkage groups represented by Time are described in detail in JP-A-61-236549, JP-A-63-98803, and JP-A-2-93487.

In Formulas (R-1), (R-2) and (R-3), PUG is a development inhibitor. PUG has a hetero atom and is connected to the sites of the compounds represented by Formulas (R-1), (R-2) and (R-3) via the hetero atom.

The examples of the development inhibitors generally known are described in *The Theory of the Photographic Process* written by T. H. James, the fourth edition, 1977, published by MaCmillan Co., Ltd., pp. 369 to 399, and JP-A-2-93487, pp. 56 to 69.

These development inhibitors may have a substituent. There can be mentioned as useful substituents, for example, a mercapto group, a nitro group, a carboxyl group, a sulfo group, a phosphono group, a hydroxy group, an alkyl group, an aralkyl group, an alkenyl group, an alkynyl group, an aryl group, an alkoxy group, an aryloxy group, an amino group, an acylamino group, a sulfonylamino group, a ureido group, a urethane group, a sulfamoyl group, a carbamoyl group, an alkylthio group, an arylthio group, a sulfonyl group, a sulfinyl group, a halogen atom, a cyano group, an aryloxycarbonyl group, an acyl group, an alkoxycarbonyl group, an acyloxy group, a carbonamido group, a sulfonamido group, and a phosphonamido group. These groups may be further substituted.

The development inhibitor represented by PUG used in the present invention is preferably a compound inhibiting a nucleus forming infectious development.

Nucleus forming infectious development is the new developing chemistry used for the image forming methods of the Fuji Film GRANDEX system (Fuji Photo Film Co., Ltd.) and the Kodak Ultratec system (Eastman Kodak Co., Ltd.), and explained in *Japan Photography Association Magazine*, vol. 52, No. 5, pp. 390 to 394 (1989) and *Journal of Photographic Science*, vol. 35, p. 162 (1987). This developing chemistry consists of the processes of a usual developing process for an exposed silver halide grain with a developing agent and a nucleus forming infectious developing process for the unexposed to weakly exposed silver halide grains in the circumference with a nucleus forming active species formed based on the cross oxidation of the oxidation product of the developing agent formed in the above developing process and a nucleus forming agent.

Accordingly, the whole developing process consists of a usual developing process and a nucleus forming process. Therefore, in addition to a usual development inhibitor conventionally known as a development inhibitor, a compound inhibiting a nucleus forming infectious developing process can exhibit an inhibiting action. The latter is called herein a nucleus forming development inhibitor.

The development inhibitor represented by PUG used in the present invention is preferably such a nucleus forming development inhibitor. Conventionally known development inhibitors also are effective as the compound acting as the nucleus forming development inhibitor. Particularly useful compounds are those having one or more nitro groups or a nitroso group, compounds having a nitrogen-containing heterocyclic structure, such as pyridine, pyrazine, quinoline, quinoxaline, and phenazine, particularly a 6-membered nitrogen-containing heteroaromatic structure, compounds having an N-halogen bond, quinones, tetrazoliums, amine oxides, azoxy compounds, and coordination compounds having an oxidation ability.

Of them, compounds having a nitro group and compounds having a pyridine structure are particularly effective.

These nucleus forming development inhibitors may have a substituent. By the various characteristics thereof, the strength of development inhibition and the ease of diffusion can be controlled. The characteristics of those substituents include, for example, an electron attractive property, an electron providing property, a hydrophobic property, a hydrophilic property, an electron charge, and an adsorbing property on silver halide.

Those previously mentioned as the substituents for conventional development inhibitors can be applied as examples of useful substituents of the nucleus forming development inhibitor.

Examples of these nucleus forming development inhibitors useful for the present invention are described in detail in JP-A-4-136839 and JP-A-4-136840, and in addition thereto, they are described as well in JP-A-4-136841, JP-A-3-15648, JP-A-3-70411, and JP-A-3-70388 as Ind.

Further, effective as the nucleus forming development inhibitor of a different series is an adsorbable compound to a silver halide grain. It has an anionic charge group or a dissociative group which can be dissociated in a developing solution to generate an anionic charge.

In Formulas (R-1), (R-2) and (R-3), there may be incorporated into R$_1$ or Time, a ballast group conventionally used in immobile photographic additives such as couplers and a group promoting adsorption of the compounds represented by Formulas (R-1), (R-2) and (R-3) onto silver halide.

The ballast group is an organic group providing a molecular weight sufficient to prevent the compounds represented by Formulas (R-1), (R-2) and (R-3) from substantially diffusing into the other layers or the processing solution. It consists of a combination of one or more of an alkyl group, an aryl group, a heterocyclic group, an ether group, a thioether group, an amido group, a ureido group, a urethane group, and a sulfonamido group. Preferred as the ballast group is a ballast group having a substituted benzene ring. In particular, a ballast group having a benzene ring substituted with a branched alkyl group is more preferred.

There can be enumerated as the adsorption accelerating group, a cyclic thioamide group such as 4-thiazoline-2-thione, 4-imidazoline-2-thione, 2-thiohydantoin, rhodanine, thiobarbituric acid, tetrazoline-5-thione, 1,2,4-triazoline-3-thione, 1,3,4-oxazoline-2-thione, benzimidazoline-2-thione, benzoxazoline-2-thione, benzothiazoline-2-thione, thiotriazine, and 1,3-imidazoline-2-thione, a chain thioamide group, an aliphatic mercapto group, an aromatic mercapto group, a heterocyclic mercapto group (in the case where a nitrogen atom is adjacent to the carbon atom to which a —SH group is bonded, it is synonymous with the cyclic thioamide group having the relationship of a tautomer therewith, and the concrete examples of this group are the same as those mentioned above), a group having a disulfide group, a 5-membered or 6-membered nitrogen-containing heterocyclic group consisting of a combination of nitrogen, oxygen, sulfur and carbon, such as benzotriazole, triazole, tetrazole, indazole, benzimidazole, imidazole, benzothiazole, thiazole, thiazoline, benzoxazole, oxazole, oxazoline, thidiazole, oxathiazole, triazine, and azaindene, and a heterocyclic quaternary salt such as benzimidazolinium.

These may further be substituted with a suitable substituent.

For example, those described as the substituents for $R_1$ can be mentioned as the substituents therefor.

Examples of the redox compound used in the present invention will be enumerated below but the present invention will not be limited thereto.

(R-1)

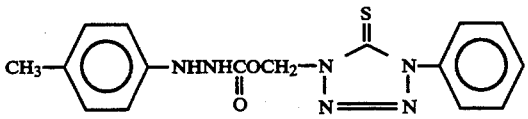

(R-2)

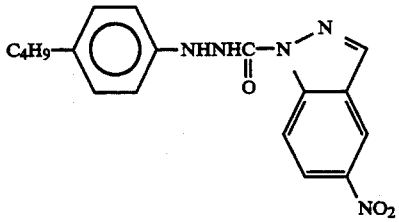

(R-3)

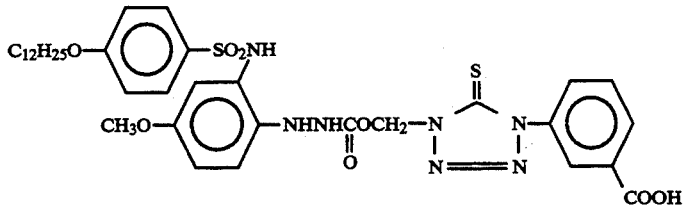

(R-4)

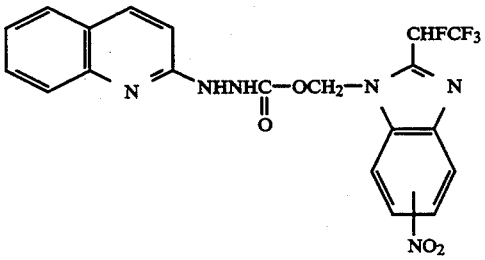

(R-5)

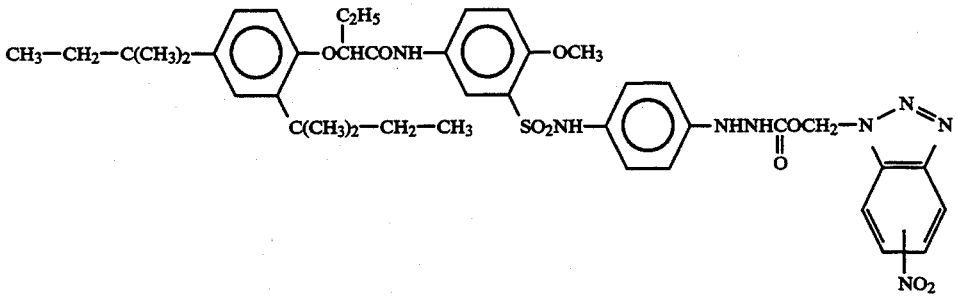

(R-6)

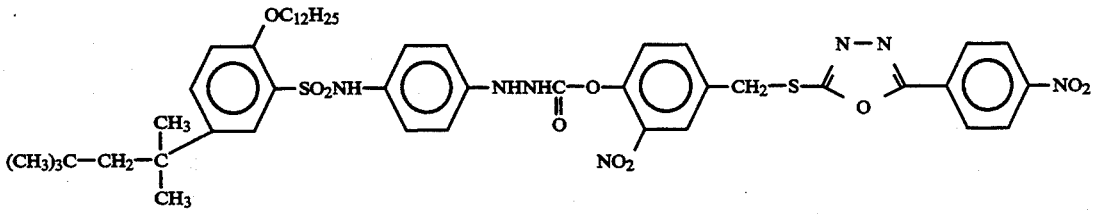

-continued
(R-7)
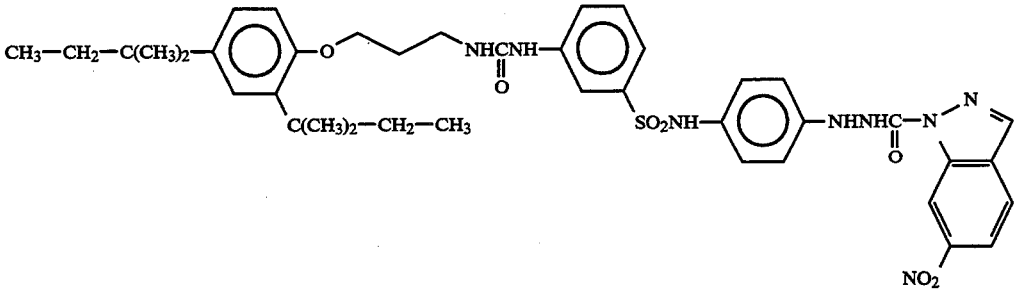
(R-8)
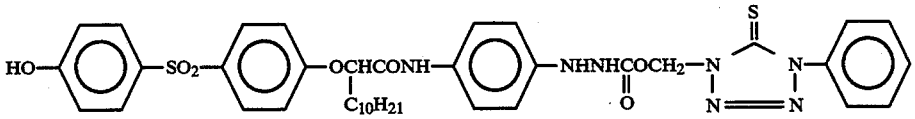
(R-9)
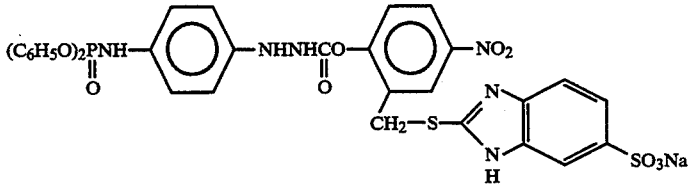
(R-10)
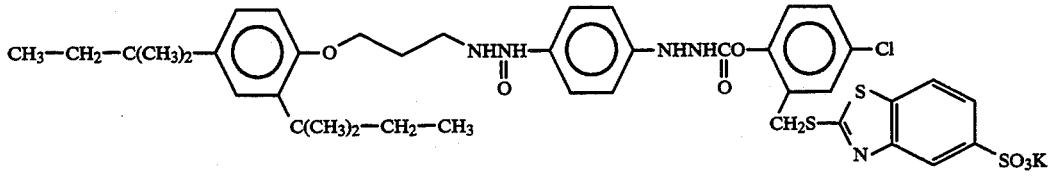
(R-11)
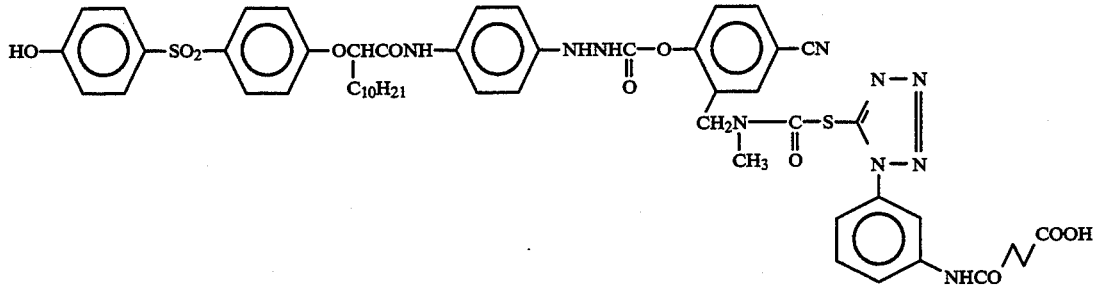
(R-12)
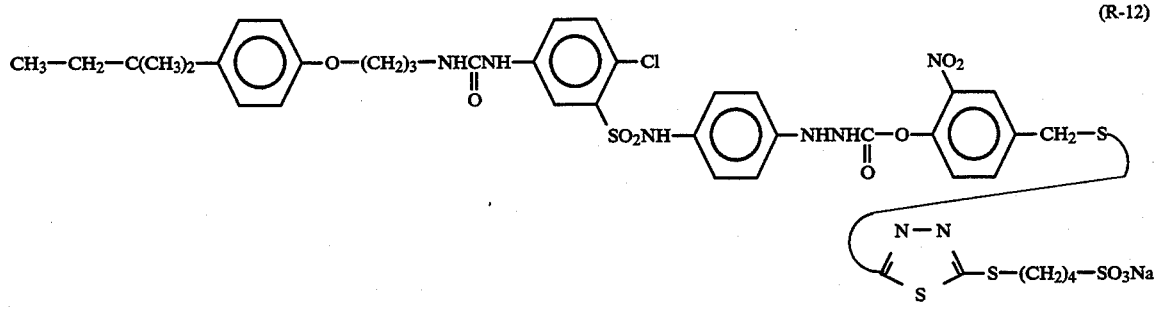

-continued
(R-13)
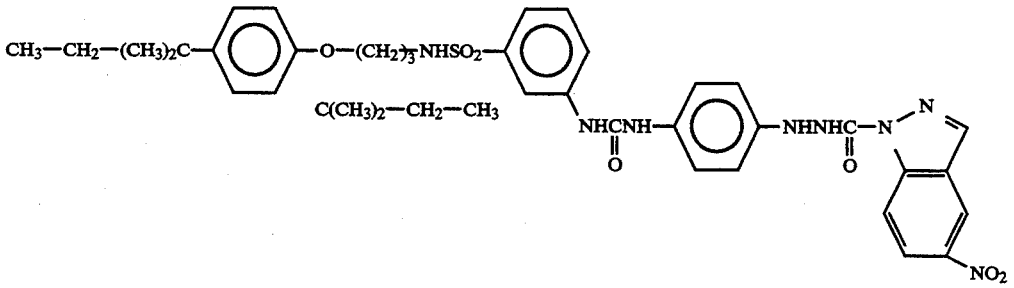
(R-14)
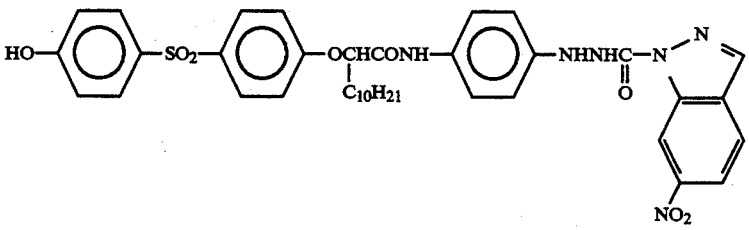
(R-15)
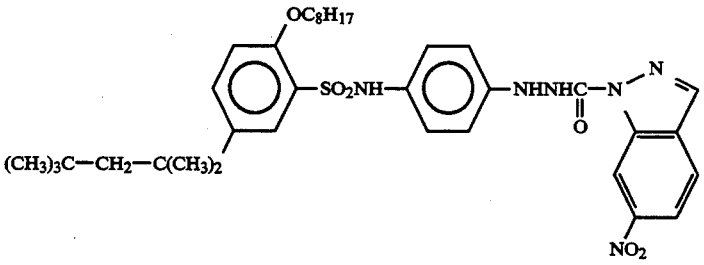
(R-16)
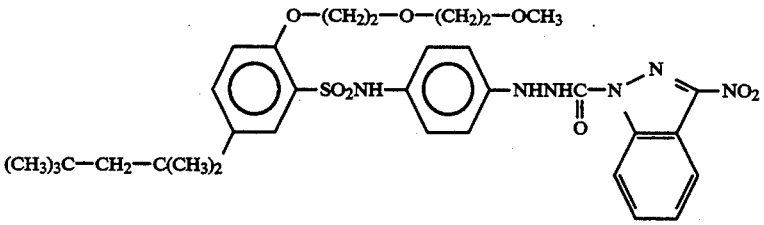
(R-17)
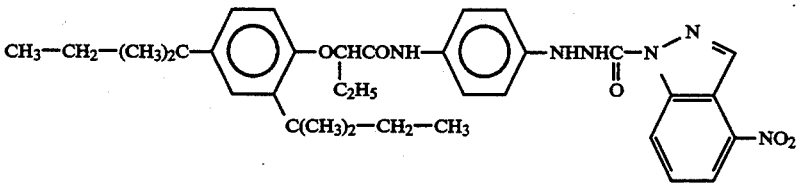
(R-18)
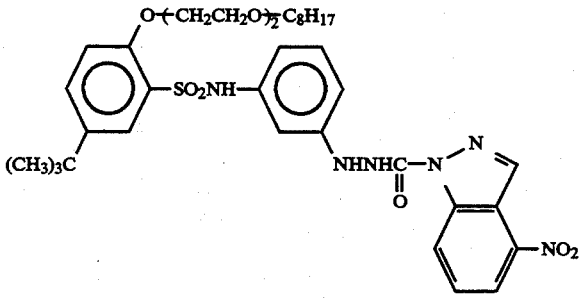

-continued
(R-19)
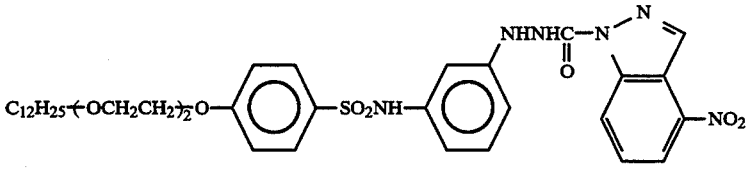
(R-20)
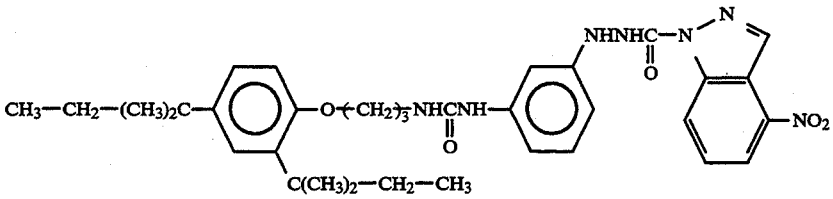
(R-21)
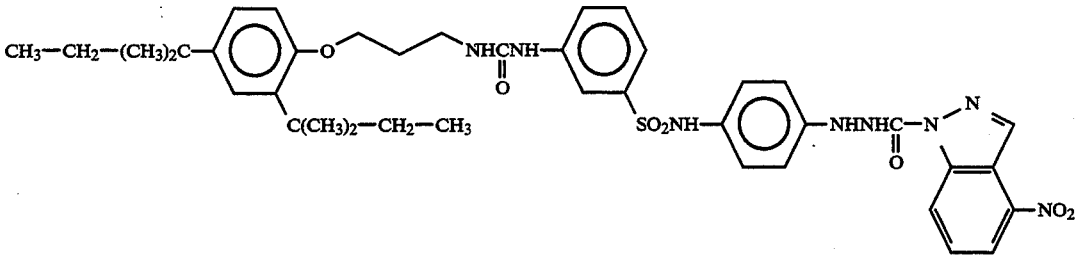
(R-22)
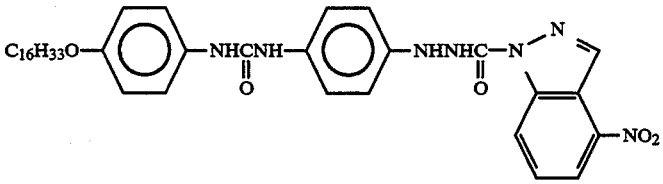
(R-23)
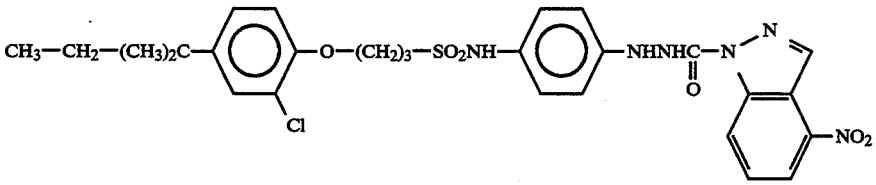
(R-24)
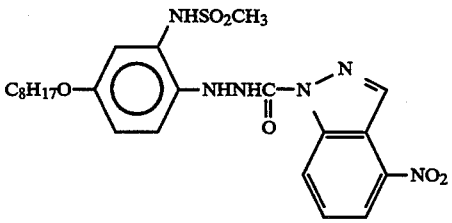
(R-25)
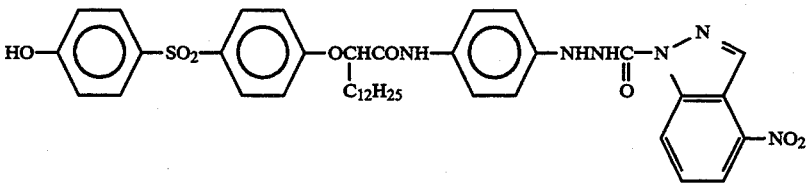

-continued
(R-26)
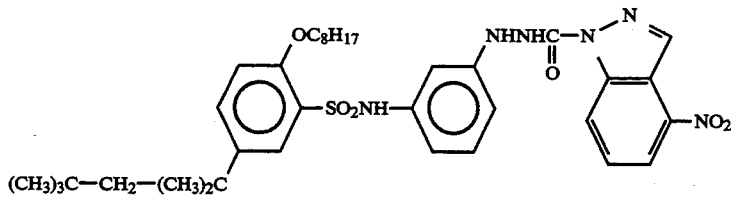
(R-27)
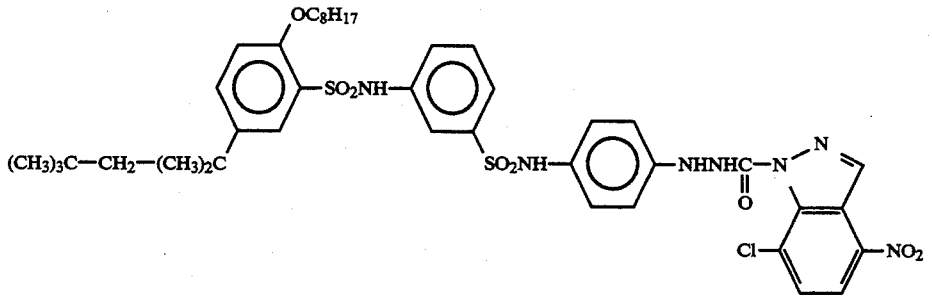
(R-28)
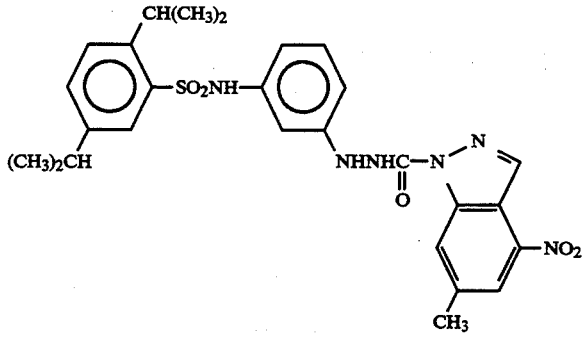
(R-29)
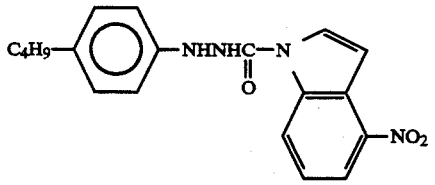
(R-30)
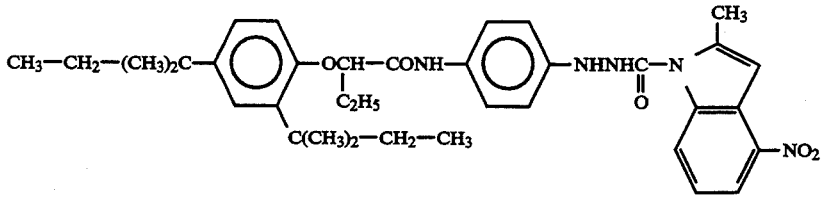
(R-31)
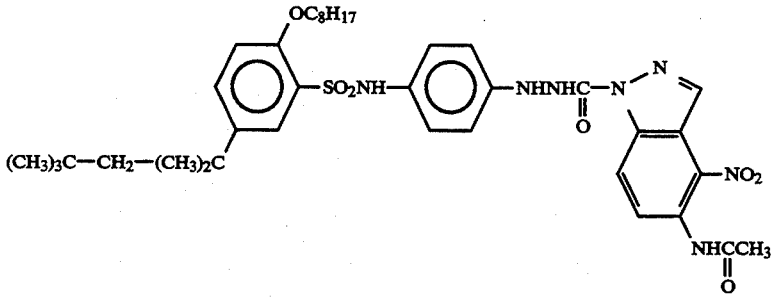

-continued
(R-32)
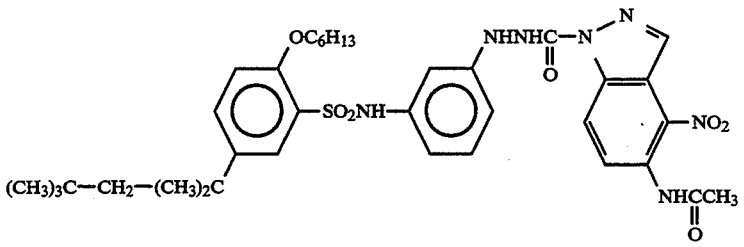
(R-33)
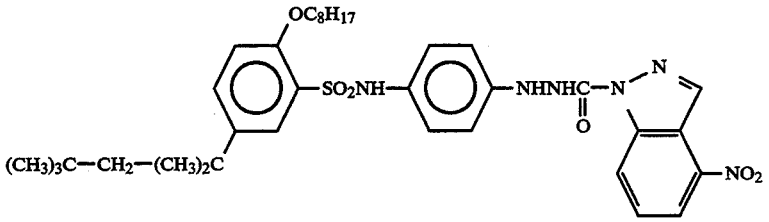
(R-34)
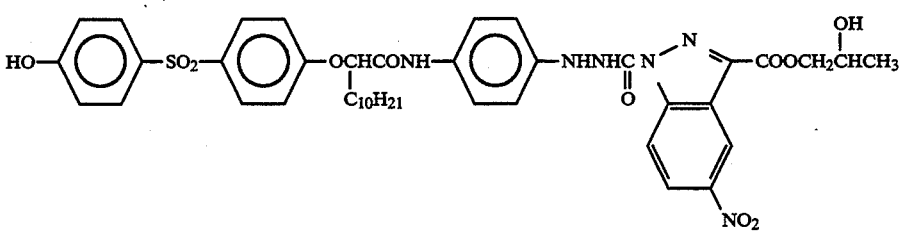
(R-35)
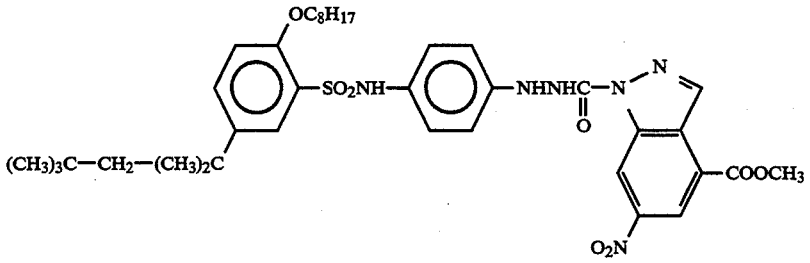
(R-36)
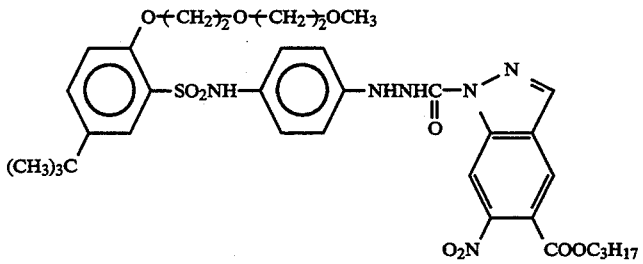
(R-37)
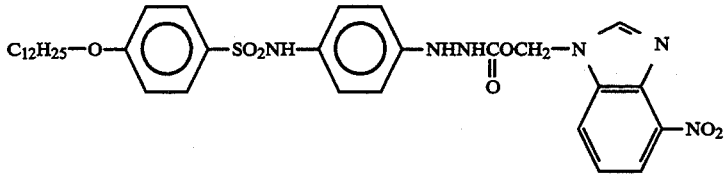
(R-38)
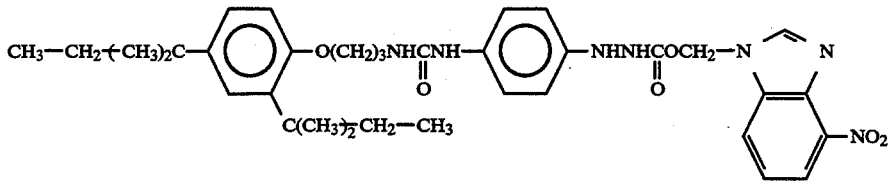

-continued
(R-39)
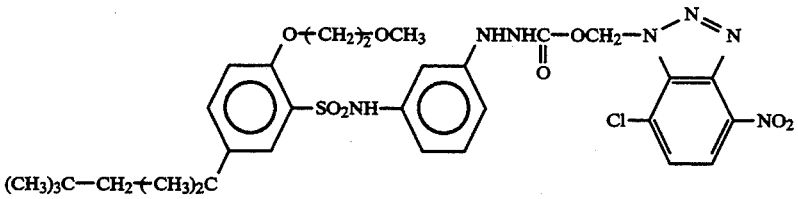
(R-40)
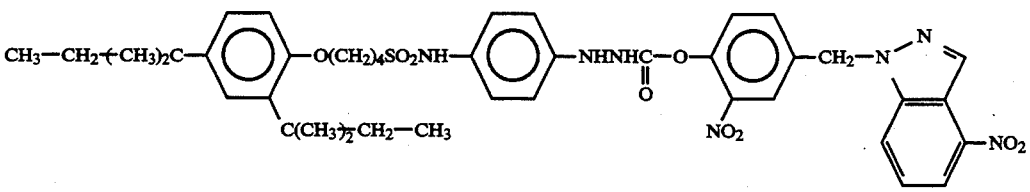
(R-41)
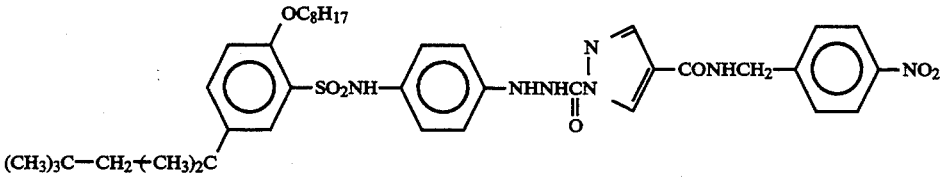
(R-42)
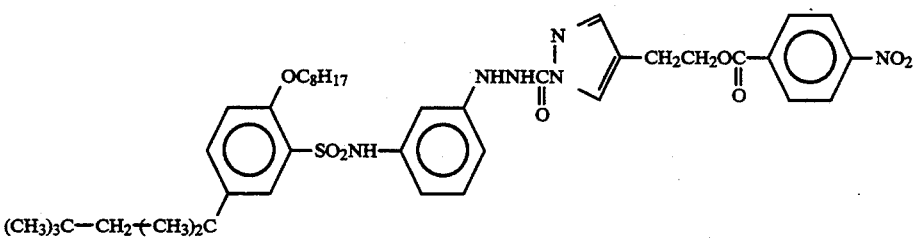
(R-43)
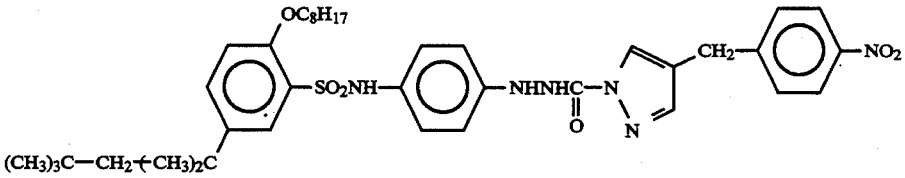
(R-44)
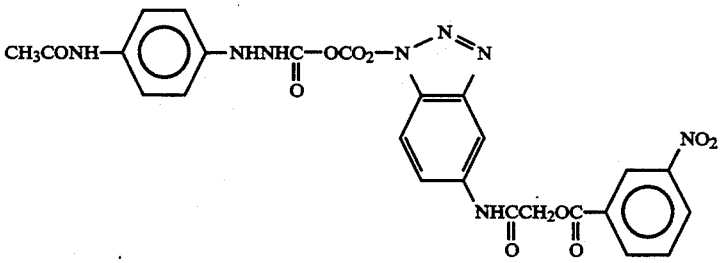
(R-45)
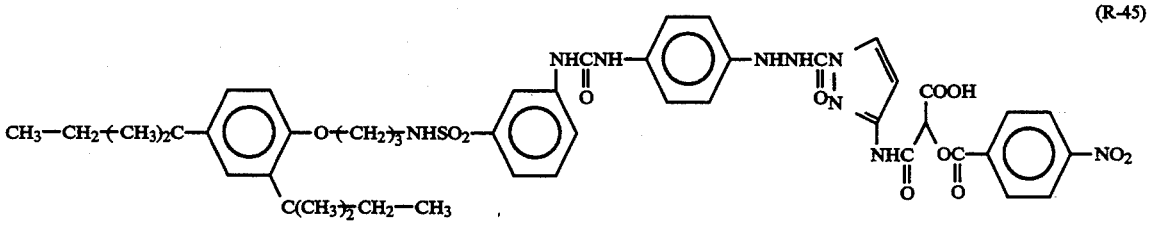
(R-46)
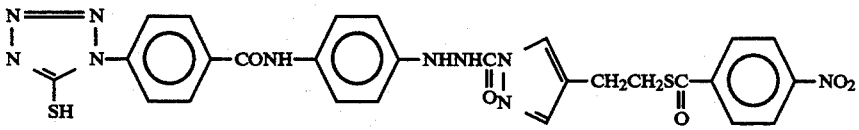

-continued
(R-47)
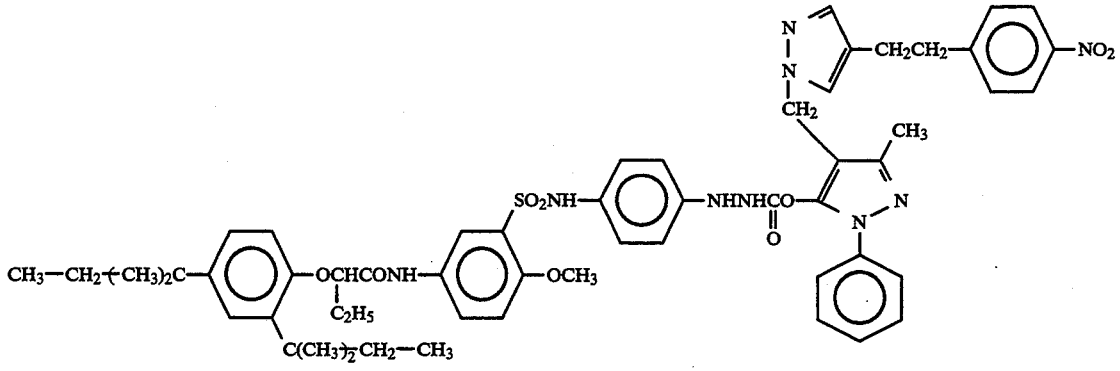
(R-48)
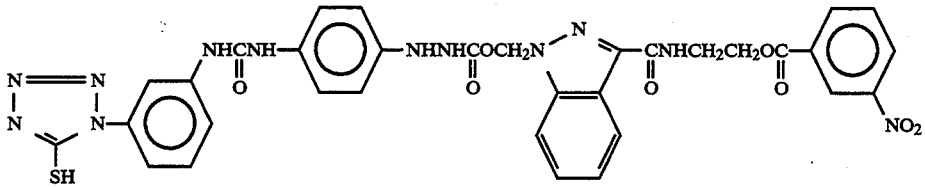
(R-49)
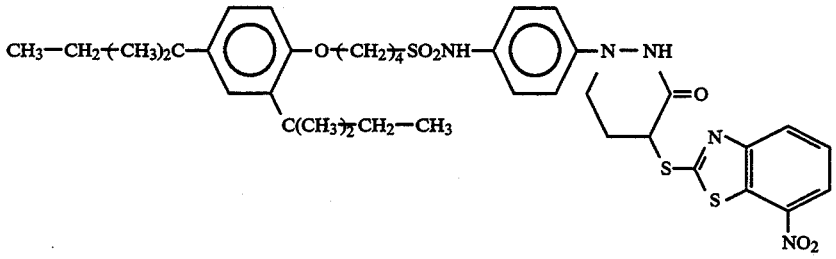
(R-50)
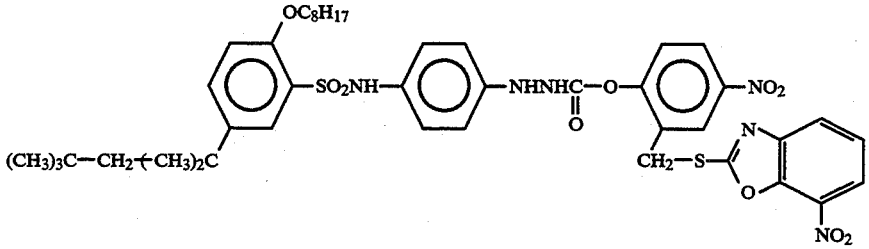
(R-51)
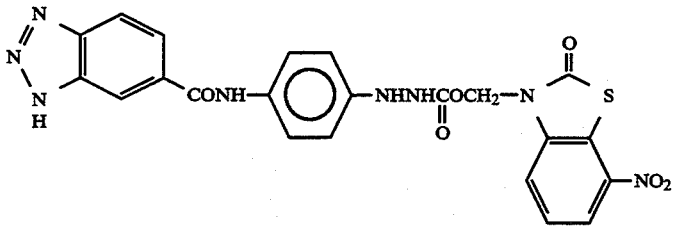
(R-52)
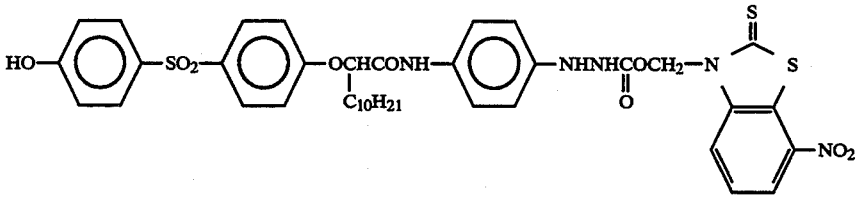

-continued
(R-53)
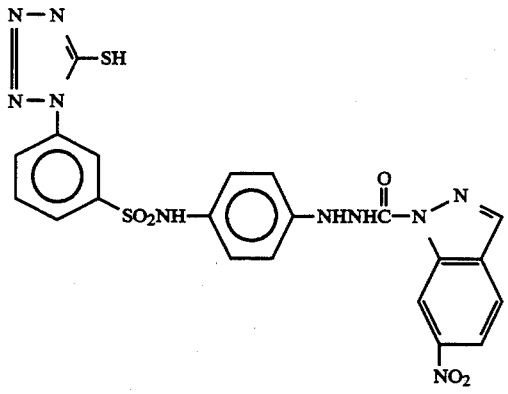
(R-54)
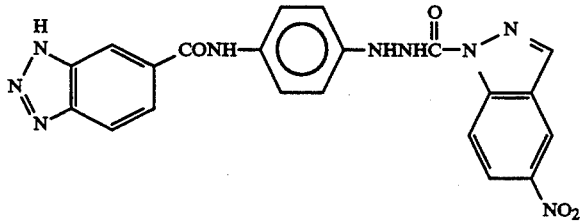
(R-55)
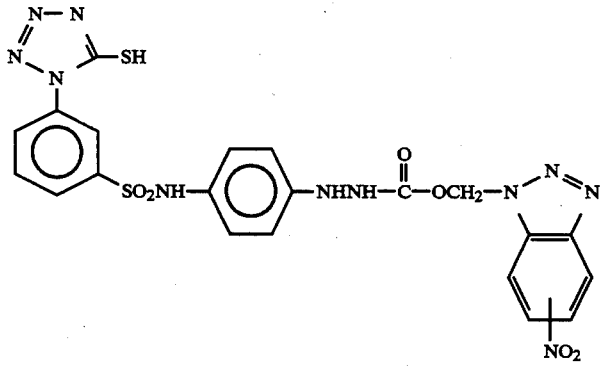
(R-56)
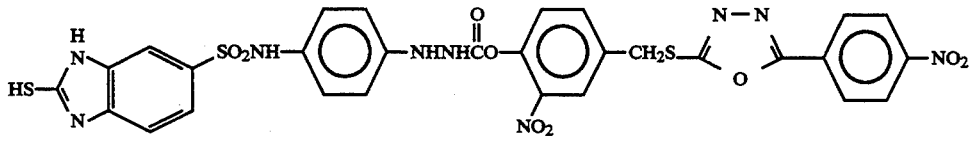
(R-57)
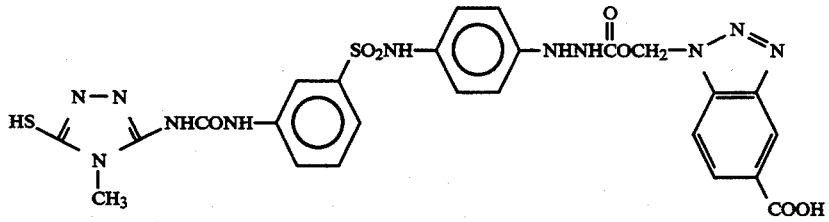

-continued
(R-58)
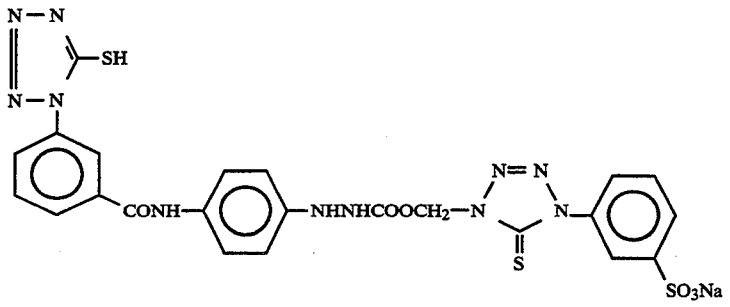
(R-59)
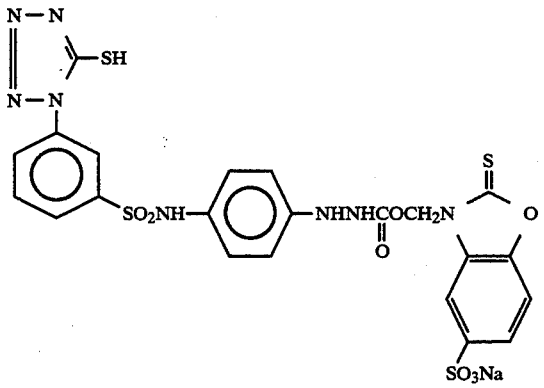
(R-60)
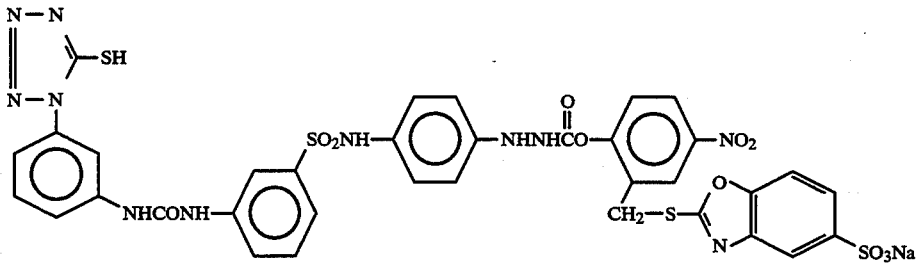
(R-61)
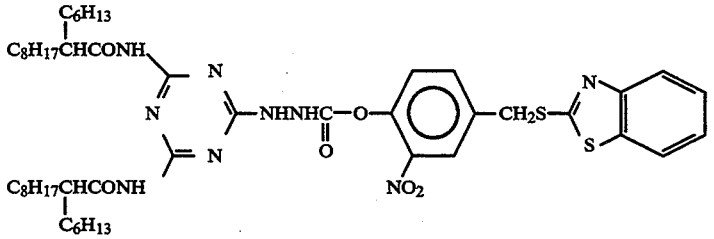
(R-62)
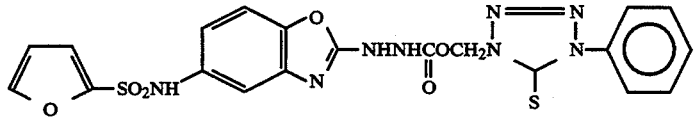
(R-63)
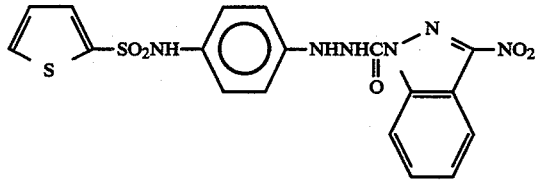

-continued
(R-64)
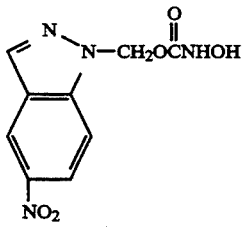
(R-65)
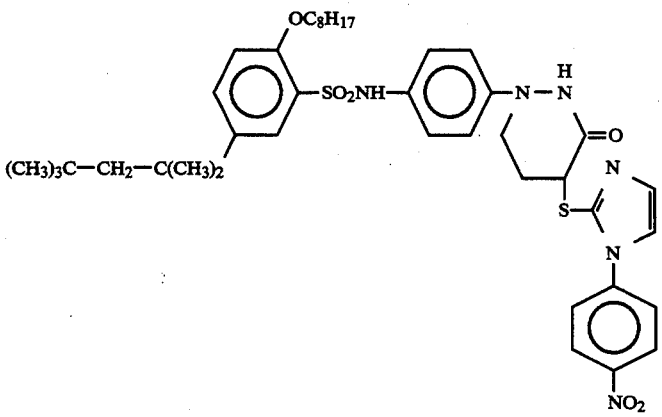
(R-66)
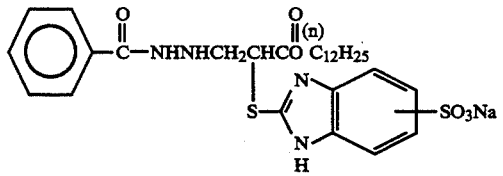
(R-67)
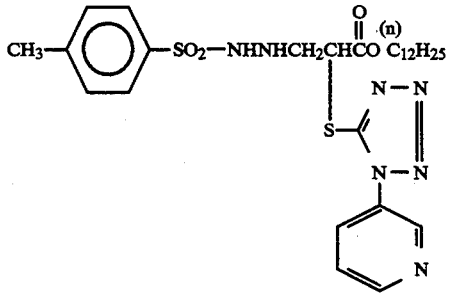
(R-68)
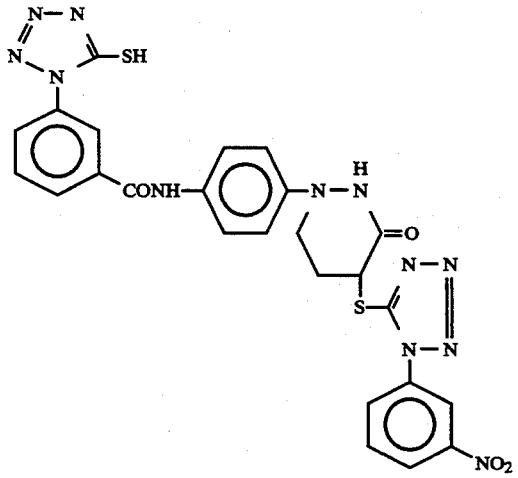
In addition to those mentioned above, there can be used as the redox compound in the preesnt inven-tion, the compounds described in, for example, JP-A-61-213847, JP-A-62-260153, Japanese Patent Application Nos. 1-102393, 1-102394, 1-102395, 1-114455, 1-290563, 2-62337, 2-64717, 2-258927, 2-258928, 2-258929, 3-15648, 3-70411, 3-70388, and 3-69466, JP-A-2-301743, and JP-A-3-174143.

The synthesis method of the redox compound used in the present invention is described in the above mentioned literature references and also described in, for example, U.S. Pat. No. 4,684,604, JP-A-63-98,803, U.S. Pat. Nos. 3,379,529, 3,620,746, 4,377,634, and 4,332878, and JP-A-49-129536, JP-A-56-153336, and JP-A-56-153342.

The redox compound according to the present invention is used within the range of $1\times10^{-6}$ to $5\times10^{-2}$ mole, more preferably $1\times10^{-5}$ to $1\times10^{-2}$ mole.

The redox compound according to the present invention can be dissolved in a suitable water miscible solvent, for example, alcohols (methanol, ethanol, propanol, and fluorinated alcohol), ketones (acetone and methyl ethyl ketone), dimethylformamide, dimethylsulfoxide, and methyl cellosolve for addition to the photographic material.

Further, the redox compound can be dissolved with the aid of an oil such as dibutyl phthalate, tricresyl phosphate, glyceryl triacetate, and diethyl phthalate, and an auxiliary solvent such as ethyl acetate and cyclohexanone to mechanically prepare an emulsified dispersion thereof by well known dispersing methods. Alternatively, powders of the redox compound can be dispersed in water by the method known as a solid matter dispersing method with a ball mill, a colloid mill or a supersonic wave.

The redox compound according to the present invention is added to a silver halide emulsion layer or another hydrophilic colloid layer. It may be added as well to at least one of the plurality of silver halide emulsion layers.

Several constitution examples are described, but the present invention will not be limited thereto.

Constitution Example 1): a silver halide emulsion layer containing a redox compound according to the present invention and a protective layer are provided on a support. The emulsion layer or protective layer may contain hydrazine compounds of Formula (I) and Formula (II) as a nucleus forming agent.

Constitution Example 2): a first silver halide emulsion layer and a second silver halide emulsion layer are provided in that order on a support. The first silver halide emulsion layer or a hydrophilic colloid layer adjacent thereto contains the hydrazine compounds of Formula (I) and Formula (II) and a second silver halide emulsion layer or a hydrophilic colloid layer adjacent thereto contains a redox compound.

Constitution Example 3): the constitution in which the order of the two emulsion layers in the constitution Example 2) is reversed.

In constitution Examples 2) and 3), an intermediate layer containing gelatin and a synthetic polymer (polyvinyl acetate and polyvinyl alcohol) may be provided between the two light-sensitive emulsion layers.

Constitution Example 4): the silver halide emulsion layer containing the hydrazine compounds of Formula (I) and Formula (II) is provided on a support and the hydrophilic colloid layer containing the redox compound is provided on the emulsion layer or between the support and the silver halide emulsion layer.

The particularly preferred constitution is in constitution Example 2) or 3).

The various additives and development processing methods used for the light-sensitive material of the present invention are not specifically limited, and those described in the following corresponding portions can be preferably applied.

| Subject | Corresponding portion |
|---|---|
| 1) Nucleus forming accelerator | Formula (II-m) or (II-p) and the compound example II-1 or II-22 at p. 9, right upper column, line 13 to p. 16, left upper column, line 10 of JP-A-2-103536; and the compounds described in JP-A-1-179939. |
| 2) Silver halide emulsion and production process thereof | p. 20, right lower column, line 12 to p. 21, left lower column, line 14 of JP-A-2-97937; P. 7, right upper column, line 19 to p. 8, left lower column, line 12 of JP-A-2-12236; and Japanese patent application No. 3-189532. |
| 3) Spectral sensitizing dye | p. 8, left lower column, line 13 to right lower column, line 4 of JP-A-2-12236; p. 16, right lower column, line 3 to p. 17, left lower column, line 20 of JP-A-2-103536; and further the spectral sensitizing dyes described in JP-A-1-112235, JP-A-2-124560, JP-A-3-7928, JP-A-3-189532, and JP-A-3-411064. |
| 4) Surface active agent | p. 9, right upper column, line 7 to right lower column, line 7 of JP-A-2-12236; and p. 2, left lower column, line 13 to p. 4, right lower column, line 18 of JP-2-18542. |
| 5) Anti-fogging agent | p. 17, right lower column, line 19 to p. 18, right upper column, line 4 and right lower column, lines 1 to 5 of JP-A-2-103536; and further the thiosulfinic acid compounds described in JP-A-1-237538. |
| 6) Polymer latex | p. 18, left lower column, lines 12 to 20 of JP-A-2-103536. |
| 7) Compound having an acid group | p. 18, right lower column, line 6 to p. 19, left upper column, line 1 of JP-A-2-103536. |
| 8) Matting agent, sliding agent and plasticizer | p. 19, left upper column, line 15 to right upper column, line 15 of JP-A-2-103536. |
| 9) Hardener | p. 18, right upper column, lines 5 to 17 of JP-A-2-103536. |
| 10) Dye | dyes described at p. 17, right lower column, lines 1 to 18 of JP-A-2-103536; and solid dyes described in JP-A-2-294638 and Japanese patent application No. 3-185773. |
| 11) Binder | p. 3, right lower column, lines 1 to 20 of JP-A-2-18542. |
| 12) Anti-black speck agent | the compounds described in U.S. Pat. No. 4,956,257, and JP-A-1-118832. |
| 13) Monomethine compound | the compounds of Formula (II) (particularly the compound example II-1 or II-26) described in JP-A-2-287532. |
| 14) Dihydroxybenzenes | p. 11, left upper column to p. 12 left lower column of JP-A-3-39948; and the compounds described in EP 452772A. |
| 15) Developing solution and developing method | p. 19, right upper column, line 16 to p. 21, left upper column, line 8 of JP-A-2-103536. |

Next, the present invention will be concretely explained with reference to the following examples.

EXAMPLE 1

Preparation of the emulsion

A 0.13M silver nitrate aqueous solution and a halide aqueous solution containing $(NH_4)_3RhCl_6$ corresponding to $1\times10^{-7}$ mole per mole of silver, 0.4M potassium bromide, and 0.09M sodium chloride were added to a gelatin aqueous solution containing sodium chloride and 1,3-dimethyl-2-imidazolidinethione by a double jet method at 38° C. for 12 minutes while stirring. Silver bromochloride grains having an average grain size of 0.15 μm and a silver chloride content of 70 mole % were obtained to thereby form nuclei. Subsequently, a 0.87M silver nitrate aqueous solution and a halide aqueous solution containing 0.26M potassium bromide and 0.65M sodium chloride were similarly added by the double jet method over a period of 20 minutes.

Then, a KI solution of $1\times10^{-3}$ mole was added to carry out a conversion and washing was carried out by a flocculation method according to a conventional method, followed by adding gelatin (40 g) and adjusting pH and pAg to 6.5 and 7.5, respectively. Further, there were added sodium thiosulfate (5 mg) and chlorauric acid (8 mg) each per mole of silver. Heat was applied at 60° C. for 60 minutes to provide a chemical sensitization processing, followed by adding 4-hydroxy-6-methyl-1,3,3a,7-tetrazaindene (150 mg) as a stabilizer. The grains thus obtained were silver bromochloride cubic grains having an average grain size of 0.27 μm and a silver chloride content of 70 mole % (fluctuation coefficient: 10%).

Preparation of the coated samples

The hydrazine compounds of the present invention were added to the above emulsion as shown in Table 1.

TABLE 1

| Sample | Hydrazine derivative (added amount) | |
|---|---|---|
| A (Comp.) | I-24 | (5 mg/m²) |

TABLE 1-continued

| Sample | Hydrazine derivative (added amount) | |
|---|---|---|
| B (Comp.) | I-28 | (10 mg/m²) |
| C (Comp.) | I-29 | (15 mg/m²) |
| D (Inv.) | I-24 | (3 mg/m²) |
| | II-9 | (4 mg/m²) |
| E (Inv.) | I-28 | (8 mg/m²) |
| | II-11 | (10 mg/m²) |
| F (Inv.) | I-28 | (8 mg/m²) |
| | II-19 | (10 mg/m²) |
| G (Inv.) | I-28 | (8 mg/m²) |
| | II-20 | (8 mg/m²) |
| H (Inv.) | I-29 | (12 mg/m²) |
| | II-21 | (12 mg/m²) |

Further, there were added $3.4\times10^{-4}$ mole of the compound of the following structural Formula (S), $2\times10^{-4}$ mole of 1-phenyl-5-mercaptotetrazole, $5\times10^{-4}$ mole of the short wave cyanine dye represented by the following structural Formula (a) each per mole of silver, the water soluble latex represented by the following structural Formula (b) (200 mg/m²), a dispersion of polyethyl acrylate (200 mg/m²), 1,3-divinylsulfonyl-2-propanol (200 mg/m²) as a hardener. ( (S)

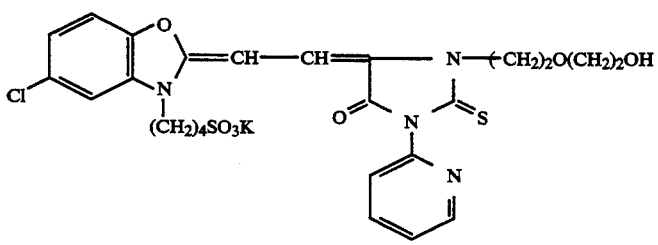

(a)

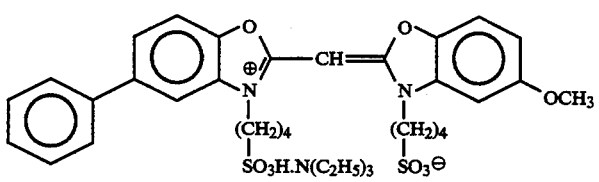

(b)

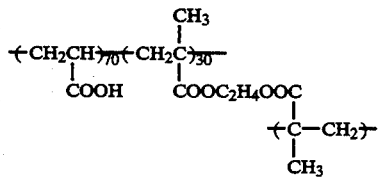

The amine compound (20 mg/m²) represented by the following structural formula was added as a nucleus forming accelerator:

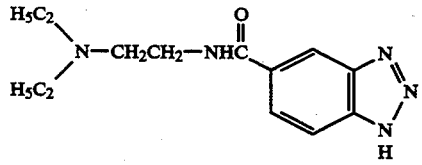

There was coated as a protective layer simultaneously with the emulsion layer, a layer containing gelatin (1.0 g/m²), an amorphous $SiO_2$ matting agent (40 mg/m²) with the particle size of about 3.5 μ, methanol silica (0.1 g/m²), polyacrylamide (100 mg/m²), hydroquinone (200 mg/m$^2$), silicon oil, and the fluorinated surface active agent represented by the following structural formula and sodium dodecylbenzenesulfonate as a coating aid:

$$C_8F_{17}SO_2N(C_3H_7)CH_2COOK$$

A back layer and a back protective layer each having the following composition were coated.

| Composition of the back layer: | |
|---|---|
| Gelatin | 3 g/m$^2$ |
| Polyethyl acrylate latex | 2 g/m$^2$ |
| Surface active agent (sodium p-dodecylbenzenesulfonate) | 40 g/m$^2$ |
| Gelatin hardener: | 110 mg/m$^2$ |

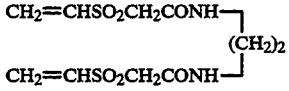

| | |
|---|---|
| Fluorinated surface active agent: $C_8F_{17}SO_2N(C_3H_7)CH_2COOK$ | 5 mg/m$^2$ |
| Mixture of Dye (a), Dye (b) and Dye (c): | |
| Dye (a) | 50 mg/m$^2$ |

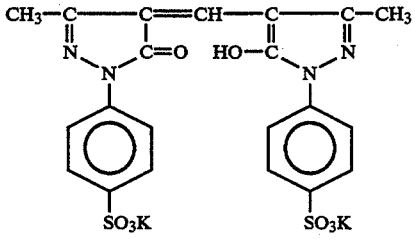

| | |
|---|---|
| Dye (b) | 100 mg/m$^2$ |

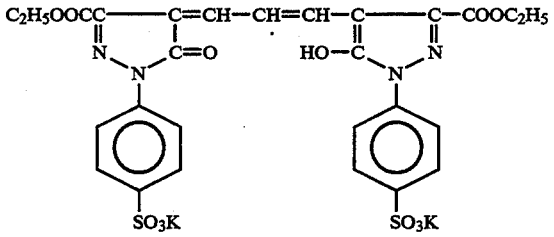

| | |
|---|---|
| Dye (c) | 50 mg/m$^2$ |

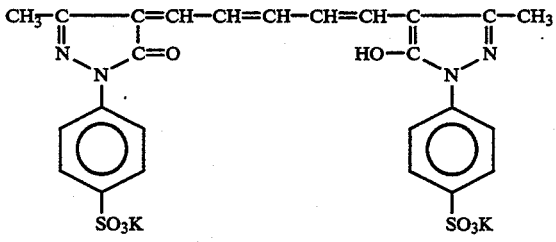

-continued

| Composition of the back protective layer: | |
|---|---|
| Gelatin | 0.8 mg/m$^2$ |
| Polymethyl methacrylate fineparticles (average particle size: 4.5 μm) | 30 mg/m$^2$ |
| Sodium dihexyl-α-sulfosuccinate | 15 mg/m$^2$ |
| Sodium dodecylbenzenesulfonate | 15 mg/m$^2$ |
| Sodium acetate | 40 mg/m$^2$ |

Evaluation

These samples were exposed to a tungsten light of 3200° K. via an optical wedge or the optical wedge and a contact screen (150L chain dot type, manufactured by Fuji Photo Film Co., Ltd.). Then, they were subjected to development in the developing solution 1 mentioned below at 34° C. for 30 seconds, fixing, washing and drying.

| Composition of the developing solution 1: | |
|---|---|
| Hydroquinone | 30.0 g |
| N-methyl-p-aminophenol | 0.3 g |
| Sodium hydroxide | 10.0 g |
| Potassium sulfite | 60.0 g |
| Disodium ethylenediaminetetraacetate | 1.0 g |
| Potassium bromide | 10.0 g |
| 5-Methylbenzotriazole | 0.4 g |
| 2-Mercaptobenzimidazole-5-sulfonic acid | 0.3 g |
| Sodium 3-(5-mercaptotetrazole)-benzenesulfonate | 0.2 g |
| Sodium toluenesulfonate | 8.0 g |
| Water was added to | 1 liter |
| pH was adjusted to | 10.2 |

GR-F1 manufactured by Fuji Photo Film Co. , Ltd. was used as a fixing solution.

Sensitivity is defined by the reciprocal of the exposure providing a density of 1.5 in the development at 34° C. for 30 seconds and expressed by the value relative to that of Sample A, which is set at 100.

The value of γ is expressed by the following equation:

$$\gamma = (3.0 - 0.3)/[\log(\text{exposure giving the density of } 3.0) - \log(\text{exposure giving the density of } 0.3)]$$

Further, there were used the processing-fatigued developing solution which was the developing solution of the above mentioned composition and obtained after 150 sheets of a 100% blackened Fuji lithortho film RO-100 with a size of 50.8 cm×61 cm were processed, and an air oxidation-fatigued developing solution obtained by leaving the developing solution of the above mentioned composition to stand in a beaker for 3 days to carry out the same test.

The results are shown in Table 2.

TABLE 2

| | Sensitivity | | | γ | | |
|---|---|---|---|---|---|---|
| Sample | New Solution | Processing-Fatigued Solution | Air Oxidation-Fatigued Solution | New Solution | Processing-Fatigued Solution | Air Oxidation-Fatigued Solution |
| A (Comp.) | 100 | 86 | 111 | 13.5 | 9.1 | 8.5 |
| B (Comp.) | 120 | 107 | 130 | 16.0 | 9.5 | 8.9 |
| C (Comp.) | 105 | 91 | 114 | 14.5 | 9.2 | 8.6 |
| D (Inv.) | 101 | 97 | 105 | 13.6 | 12.1 | 11.5 |
| E (Inv.) | 118 | 115 | 122 | 16.1 | 15.5 | 15.0 |

TABLE 2-continued

| Sample | Sensitivity New Solution | Sensitivity Processing-Fatigued Solution | Sensitivity Air Oxidation-Fatigued Solution | Y New Solution | Y Processing-Fatigued Solution | Y Air Oxidation-Fatigued Solution |
|---|---|---|---|---|---|---|
| F (Inv.) | 119 | 116 | 123 | 16.1 | 15.3 | 15.1 |
| G (Inv.) | 121 | 120 | 123 | 16.3 | 15.9 | 15.7 |
| H (Inv.) | 104 | 100 | 108 | 14.7 | 14.2 | 14.0 |

In the case where only the formylhydrazine compound is used, as in Samples A, B and C, the fluctuation of sensitivity following the change in the developing solution composition is large and the degree of soft gradation is large as well. However, the combined use of two kinds of hydrazine compounds, as in the samples of the present invention, decreases the change in the above mentioned photographic performances to a large extent.

EXAMPLE 2

Preparation of the image forming layer emulsion

A 0.37M silver nitrate aqueous solution and a halide aqueous solution containing $K_2Rh(H_2O)Cl_5$ corresponding to $1\times10^{-7}$ mole and $K_2IrCl_6$ corresponding to $2\times10^{-7}$ mole each per mole of silver, 0.16M potassium bromide, and 0.22M sodium chloride were added to a 2% gelatin aqueous solution containing 0.08M sodium chloride and 1,3-dimethyl-2-imidazolidinethione by a double jet method at 38° C. for 12 minutes while stirring. Silver bromochloride grains having an average grain size of 0.20 μm and a silver chloride content of 55 mole % were obtained to thereby form nuclei. Subsequently, a 0.63M silver nitrate aqueous solution and a halide aqueous solution containing 0.23M potassium bromide and 0.43M sodium chloride were similarly added by the double jet method over a period of 20 minutes.

Then, a KI solution of $1\times10^{-3}$ mole per mole of silver was added to carry out a conversion and washing was carried out by a flocculation method according to a conventional method, followed by adding gelatin (40 g) per mole of silver and adjusting pH and pAg to 6.0 and 7.3, respectively. Further, there were added sodium benzenethiosulfonate (7 mg), benzenesutfinic acid (2 mg), chlorauric acid (8 mg), and sodium thiosulfate (5 mg) each per mole of silver. Heat was applied at 60° C. for 45 minutes to provide a chemical sensitization, followed by adding 4-hydroxy-6-methyl-1,3,3a,7-tetrazaindene (150 mg) as a stabilizer and Proxel as a preservative. The grains thus obtained were silver bromochloride cubic grains having an average grain size of 0.27 μm and a silver chloride content of 60 mole % (fluctuation coefficient: 10%).

There was added as a sensitizing dye to the emulsion thus obtained, $7\times10^{-4}$ mole per mole silver of potassium 5-[3-(4-sulfobutyl)-5-chloro-2-benzoxazolidilidene]ethylidene-1-hydroxyethoxyethyl-3-(2-pyridyl)-2-thiohydantoin. Further added were $4\times10^{-4}$ mole of the short wave cyanine dye represented by the following structural Formula (A), $3\times10^{-4}$ mole of 1-phenyl-5-mercaptotetrazole, $4\times10^{-4}$ mole of the mercapto compound represented by the following structural Formula (B), $3\times10^{-4}$ mole of the mercapto compound represented by the following structural Formula (C), $4\times10^{-4}$ mole of the triazine compound represented by the following structural Formula (D), $2\times10^{-3}$ mole of 5-chloro-8-hydroxyquinoline, the hydrazine compound of the present invention as shown in Table 3, and further sodium N-oleyl-N-methyltaurine (30 mg/m²). There were added thereto, a dispersion of polyethyl acrylate (500 mg/m²) and 1,2-bis(vinylsulfonylacetoamide)ethane (30 mg/m²) as a hardener, whereby an image forming layer coating solution was prepared.

(A)

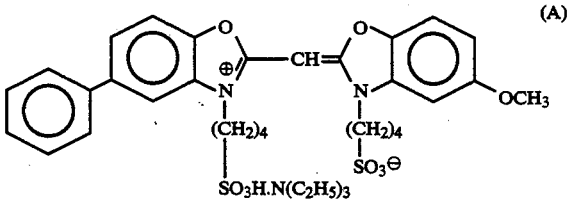

(B)

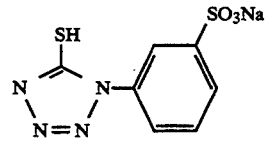

(C)

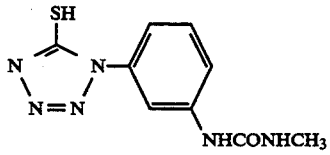

(D)

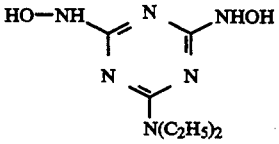

TABLE 3

| Sample | Hydrazine derivative: Image Forming Layer | | Hydrazine derivative: Intermediate Layer | Redox Compound |
|---|---|---|---|---|
| A (Comp.) | I-7 | (30 mg/m²) | | — |
| B (Comp.) | I-7 | (30 mg/m²) | — | R-1 |
| C (Inv.) | I-7 | (20 mg/m²) | — | — |
| | II-16 | (30 mg/m²) | | |
| D (Inv.) | I-7 | (20 mg/m²) | — | R-1 |
| | II-10 | (10 mg/m²) | | |
| E (Inv.) | I-7 | (20 mg/m²) | — | R-1 |
| | II-19 | (20 mg/m²) | | |
| F (Inv.) | I-7 | (20 mg/m²) | — | R-1 |
| | II-16 | (30 mg/m²) | | |
| G (Inv.) | I-7 | (10 mg/m²) | | |
| | I-23 | (1 mg/m²) | — | R-1 |
| | II-16 | (20 mg/m²) | | |
| H (Inv.) | I-27 | (30 mg/m²) | — | R-1 |
| | II-11 | (30 mg/m²) | | |
| I (Inv.) | I-7 | (30 mg/mi) | II-16 (40 mg/m²) | R-1 |

Preparation of the redox compound-containing emulsion

A 1.0M silver nitrate aqueous solution and a halide aqueous solution containing $(NH_4)_3RhCl_6$ corresponding to $3\times10^{-7}$ mole per mole of silver, 0.3M potassium bromide, and 0.74M sodium chloride were added to a 2% gelatin aqueous solution containing 0.08M sodium chloride and 1,3-dimethyl-2-imidazolidinethione by the double jet method at 45° C. for 30 minutes while stirring. Silver bromochloride grains having an average grain size of 0.30 μm and a silver chloride content of 70 mole % were obtained. Then, a KI solution of $1\times10^{-3}$ per mole of silver mole was added to carry out a conversion, and washing was carried out by a flocculation method according to a conventional method, followed by adding gelatin (40 g) per mole of silver and adjusting pH and pAg to 6.0 and 7.6, respectively. Further, there were added sodium benzenethiosulfonate (7 mg), benzenesulfinic acid (2 mg), chlorauric acid (8 mg), and sodium thiosulfate (5 mg) each per mole of silver. Heat was applied at 60° C. for 60 minutes to provide a chemical sensitization, followed by adding 4-hydroxy-6-methyl-1,3,3a,7-tetrazaindene (350 mg) as a stabilizer and Proxel as a preservative. The grains thus obtained were silver bromochloride cubic grains having an average grain size of 0.30 μm and a silver chloride content of 70 mole % (fluctuation coefficient: 9%).

There were added to the emulsion thus obtained, $5\times10^{-4}$ mole of potassium 5-[3-(4-sulfobutyl)-5-chloro-2-benzoxazolidilidene]ethylidene-1-hydroxy ethoxyethyl-3-(2-pylidyl)-2-thiohydantoin as a sensitizing dye. Further added were the dye represented by the following structural Formula (J) (10 mg/m²), a dispersion of polyethyl acrylate (250 mg/m²), and further the redox compound represented by the following structural Formula (R-1) (90 mg/m²) as shown in Table 3.

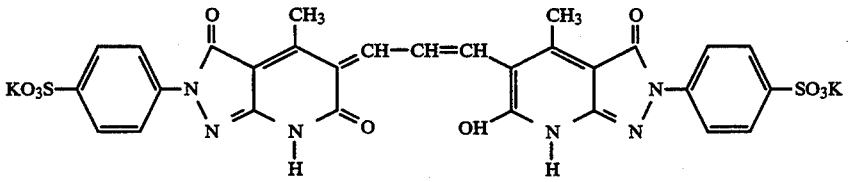

(J)

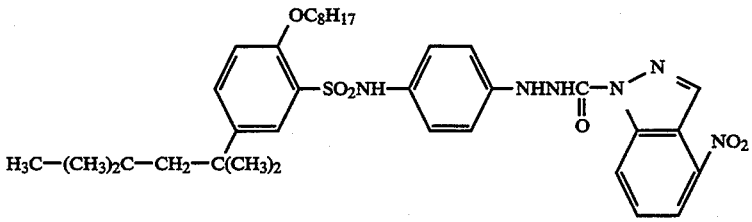

(R-1)

Preparation of the intermediate layer coating solution

There were added to a gelatin aqueous solution, the hydrazine compounds of the present invention as shown in Table 3, sodium ethanethiosulfonate (5 mg/m²), the dye represented by the following structural formula (K) (100 mg/m²), hydroquinone (100 mg/m²), the triol compound represented by the following structural Formula (L) (50 mg/m²), and a dispersion of polyethyl acrylate (350 mg/m²), whereby an intermediate layer coating solution was prepared.

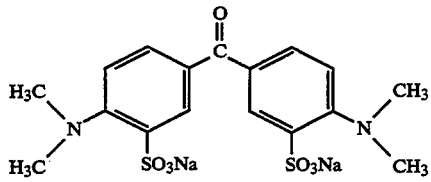

(K)

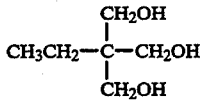

(L)

There were coated on a polyethylene terephthalate film subbed with gelatin, a layer of gelatin (0.2 g/m²) containing bis(vinylsulfonyl)methane (40 mg/m²) for the lowest layer, a hydrazine-containing layer (Ag 3.4 g/m², gelatin 1.6 g/m²), a layer containing a redox compound (Ag 0.2 g/m², gelatin 0.2 g/m²) via an intermediate layer (gelatin 0.8 g/m²), and further provided thereon as a protective layer, a layer containing gelatin (0.3 g/m²), an amorphous $SiO_2$ matting agent (60 mg/m²) with a particle size of about 3.5μ, methanol silica (0.1 g/m²), liquid paraffin (50 mg/m²), and a fluorinated surface active agent (5 mg/m²) represented by the following structural Formula (F) and sodium dodecylbenzenesulfonate (20 mg/m²) as a coating aid, whereby the samples as shown above in Table 3 were obtained.

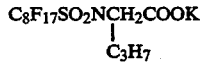

(F)

A back layer and a back protective layer each having the following composition were coated.

| Composition of the back layer: | |
|---|---|
| Gelatin | 3.2 g/m² |
| Surface active agent (sodium p-dodecylbenzenesulfonate) | 40 mg/m² |
| Sodium dihexyl-α-sulfosuccinate | 40 mg/m² |
| Gelatin hardener (1,3-divinylsulfonyl-2-propanol) | 200 mg/m² |
| A dye mixture of the following Dyes (M), (H), (I) and (J) | |

-continued

| | |
|---|---|
| Dye (M) | 20 mg/m$^2$ |
| Dye (H) | 50 mg/m$^2$ |
| Dye (I) | 20 mg/m$^2$ |
| Dye (J) | 30 mg/m$^2$ |

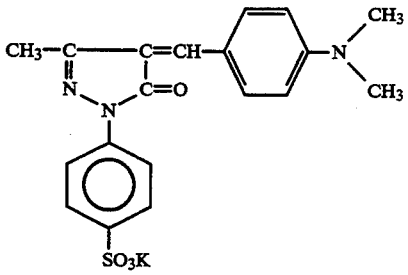

(M)

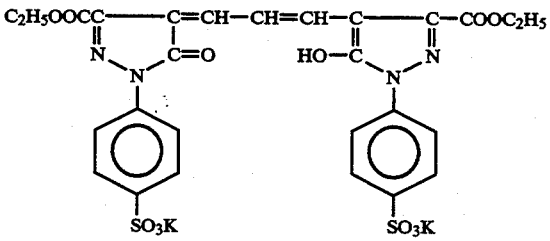

(H)

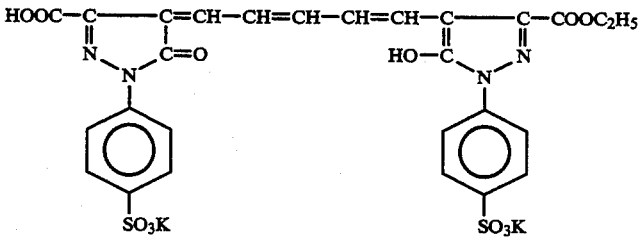

(I)

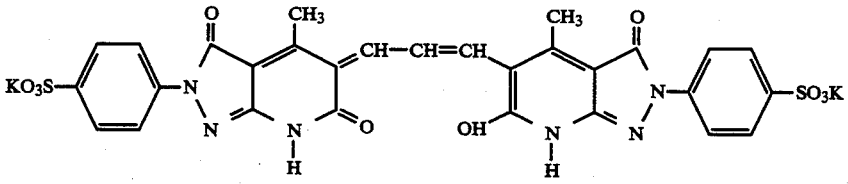

(J)

| Composition of the back protective layer: | |
|---|---|
| Gelatin | 1.3 g/m$^2$ |
| Polymethyl methacrylate fine particles (average particle size: 2.5μ) | 20 mg/m$^2$ |
| Sodium p-dodecylbenzenesulfonate | 15 mg/m$^2$ |
| Sodium dihexyl-α-sulfosuccinate | 15 mg/m$^2$ |
| Sodium acetate | 60 mg/m$^2$ |

Evaluation

These samples were exposed to a tungsten light of 3200° K. via an optical wedge and a contact screen (150L chain dot type, manufactured by Fuji Photo Film Co., Ltd.). Then, they were subjected to a processing with the automatic developing machine Model FG-660F (manufactured by Fuji Photo Film Co., Ltd.) in the developing solution of the composition mentioned below at 34° C. for 30 seconds.

GR-F1 (manufactured by Fuji Photo Film Co., Ltd.) was used as a fixing solution.

The sensitivity and γ are defined similarly to those in Example 1.

A halftone dot gradation is expressed by the following equation:

| Composition of the developing solution: | |
|---|---|
| Hydroquinone | 50.0 g |
| N-methyl-p-aminophenol | 0.3 g |
| Sodium hydroxide | 18.0 g |
| 5-Sulfosalicylic acid | 55.0 g |
| Potassium sulfite | 110.0 g |
| Disodium ethylenediaminetetraacetate | 1.0 g |
| Potassium bromide | 10.0 g |
| 5-Methylbenzotriazole | 0.4 g |
| 2-Mercaptobenzimidazole-5-sulfonic acid | 0.3 g |
| Sodium 3-(5-mercaptotetrazole)-benzenesulfonate | 0.2 g |
| N-n-butyl diethanolamine | 15.0 g |
| Sodium toluenesulfonate | 8.0 g |
| Water was added to | 1 liter |
| pH was adjusted to | 11.8 |

-continued

| Composition of the developing solution: |
|---|
| (by adding potassium hydroxide) |

Further, there were used a processing-fatigued developing solution which was the developing solution of the above mentioned composition and obtained after 150 sheets of a 100% blackened Fuji lithortho film RO-100 with the size of 50.8 cm ×61 cm were processed and an air oxidation-fatigued developing solution obtained by leaving the developing solution of the above mentioned composition to stand in a beaker for 3 days to carry out the same test.

The results are shown in Table 4.

TABLE 4

| | Sensitivty | | | Y | | | Halftone |
|---|---|---|---|---|---|---|---|
| Sample | New Solution | Processing-Fatigued Solution | Air Oxidation-Fatigued Solution | New Solution | Processing-Fatigued Solution | Air Oxidation-Fatigued Solution | Gradation New Solution |
| A (Comp.) | 100 | 85 | 110 | 13.1 | 8.2 | 9.9 | 1.16 |
| B (Comp.) | 101 | 85 | 87 | 13.0 | 9.2 | 8.1 | 1.40 |
| C (Inv.) | 103 | 101 | 100 | 13.6 | 13.0 | 12.8 | 1.17 |
| D (Inv.) | 101 | 95 | 97 | 13.0 | 12.7 | 12.5 | 1.38 |
| E (Inv.) | 102 | 96 | 96 | 13.1 | 12.7 | 12.5 | 1.39 |
| F (Inv.) | 101 | 100 | 100 | 13.1 | 13.0 | 12.9 | 1.39 |
| G (Inv. | 103 | 102 | 101 | 13.0 | 13.2 | 13.0 | 1.42 |
| H (Inv.) | 100 | 95 | 97 | 13.0 | 12.8 | 12.6 | 1.42 |
| I (Inv.) | 101 | 98 | 98 | 13.1 | 12.7 | 12.6 | 1.40 |

As can be found from the comparison of Sample B with Sample F, the combined use of the hydrazine compounds of the present invention improves a low sensitization following the change in the developing solution composition and a soft gradation. Further, as can be found from Sample I, the independent presence of those hydrazine compounds each in a different layer provides a similar effect.

EXAMPLE 3

Preparation of the developing solution and the image forming layer emulsion

The developing solution having the same composition as that in Example 2 was prepared and the image forming layer emulsion was prepared in the same manner as that in Example 2.

There was added as a sensitizing dye to the emulsion thus obtained, $7\times10^{-4}$ mole per mole silver of potassium 5-[3-(4-sulfobutyl)-5-chloro-2-benzoxazolidilidene]ethylidene-1-hydroxyethoxyethyl-3-(2-pyridyl)-2-thiohydantoin. Further added were $4\times10^{-4}$ mole of the short wave cyanine dye represented by the structural Formula (A) used in Example 2, $3\times10^{-4}$ mole of 1-phenyl-5-mercaptotetrazole, $4\times10^{-4}$ mole of the mercapto compound represented by the structural Formula (B) used in Example 2, $3\times10^{-4}$ mole of the mercapto compound represented by the structural Formula (C) used in Example 2, $4\times10^{-4}$ mole of the triazine compound represented by the structural Formula (D) used in Example 2, $2\times10^{-3}$ mole of 5-chloro-8-hydroxyquinoline, the hydrazine compound of the present invention as shown in Table 5, and further sodium N-oleyl-N-methyltaurine (30 rag/m$^2$). There were added thereto, a dispersion of polyethyl acrylate (500 mg/m$^2$) and 1,2-bis(vinylsulfonylacetoamide)ethane (30 mg/m$^2$) as a hardener, whereby an image forming layer coating solution was prepared.

TABLE 5

| | Hydrazine derivative | | | |
|---|---|---|---|---|
| Sample | Image Forming Layer | | Intermediate Layer | Redox Compound |
| A (Comp.) | I-7 | (30 mg/m$^2$) | — | R-33 |
| B (Inv.) | I-7 | (30 mg/m$^2$) | II-16 (40 mg/m$^2$) | — |
| C (Inv.) | I-7 | (20 mg/m$^2$) | — | — |
| | II-16 | (30 mg/m$^2$) | | |
| D (Inv.) | I-7 | (20 mg/m$^2$) | — | R-33 |
| | II-10 | (10 mg/m$^2$) | | |
| E (Inv.) | I-7 | (20 mg/m$^2$) | — | R-33 |
| | II-19 | (20 mg/m$^2$) | | |
| F (Inv.) | I-7 | (20 mg/m$^2$) | — | R-33 |
| | II-16 | (30 mg/m$^2$) | | |
| G (Inv.) | I-7 | (10 mg/m$^2$) | | |
| | I-23 | (3 mg/m$^2$) | —. | R-33 |
| | II-16 | (20 mg/m$^2$) | | |
| H (Inv.) | I-27 | (30 mg/m$^2$) | — | R-33 |
| | II-11 | (30 mg/m$^2$) | | |
| I (Inv.) | I-7 | (30 mg/m$^2$) | II-16 (40 mg/m$^2$) | R-33 |

Preparation of the redox compound-containing emulsion

The redox compound-containing emulsion was prepared in the same manner as that in Example 2. There were added to the emulsion thus obtained, $5\times10^{-4}$ mole of potassium 5-[3-(4-sulfobutyl)-5-chloro-2-benzoxazolidilidene]ethylidene-1-hydroxyethoxyethyl-3-(2-pylidyl)-2-thiohydantoin as a sensitizing dye. Further added were the dye (10 mg/m$^2$) represented by the structural Formula (J) used in Example 2, a dispersion of polyethyl acrylate (250 mg/m$^2$), and further the redox compound of the present invention (R-33), so that the coated amount thereof was 90 mg/m$^2$.

Preparation of the intermediate layer coating solution

The intermediate layer coating solution was prepared in the same manner as that in Example 2.

There were coated in the same manner as that in Example 2 on a polyethylene terephthalate film subbed with gelatin, a layer of gelatin (0.2 g/m$^2$) containing bis(vinylsulfonyl)ethane (40 mg/m$^2$) for the lowest layer, a hydrazine-containing layer (Ag 3.4 g/m$^2$, gelatin 1.6 g/m$^2$), a layer containing a redox compound (Ag 0.2 g/m$^2$, gelatin 0.2 g/m$^2$) via an intermediate layer (gelatin 0.8 g/m$^2$), and further provided thereon as a protective layer, a layer containing gelatin (0.3 g/m$^2$), an amorphous $SiO_2$ matting agent (60 mg/m$^2$) with a particle size of about 3.5 μ, methanol silica (0.1 g/m$^2$), liquid paraffin (50 mg/m$^2$), and the fluorinated surface active agent (5 mg/m$^2$) represented by the structural Formula (F) used in Example 2 and sodium dodecylbenzensulfonate (20 mg/m$^2$) as a coating aid, whereby the samples as shown above in Table 5 were obtained. A back layer and a back protective layer were prepared and coated in the same manner as those in Example 2.

Evaluation

These samples were exposed to a tungsten light of 3200° K. via an optical wedge and a contact screen (150L chain dot type, manufactured by Fuji Photo Film Co., Ltd.). Then, they were subjected to a processing with the automatic developing machine Model FG-660F (manufactured by Fuji Photo Film Co. , Ltd.) in the developing solution of the above mentioned composition at 34° C. for 30 seconds.

GR-F1 (manufactured by Fuji Photo Film Co., Ltd.) was used as a fixing solution.

The sensitivity and $\gamma$ are defined similarly to those in Example 1.

Also, a halftone dot gradation is defined similarly to that in Example 2.

Further, there were used the processing-fatigued developing solution which was the developing solution of the above mentioned composition and obtained after 150 sheets of a 100% blackened Fuji lithortho film GA-100 with the size of 50.8 cm $\times$61 cm were processed and an air oxidation-fatigued developing solution obtained by leaving the developing solution of the above mentioned composition to stand in a beaker for 3 days to carry out the same test.

The results are shown in Table 6.

TABLE 6

| Sample | Sensitivty | | | $\gamma$ | | | Halftone |
|---|---|---|---|---|---|---|---|
| | New Solution | Processing-Fatigued Solution | Air Oxidation-Fatigued Solution | New Solution | Processing-Fatigued Solution | Air Oxidation-Fatigued Solution | Gradation New Solution |
| A (Comp.) | 100 | 85 | 87 | 13.0 | 9.5 | 8.1 | 1.40 |
| B (Inv.) | 101 | 97 | 96 | 13.5 | 13.1 | 12.9 | 1.16 |
| C (Inv.) | 103 | 101 | 100 | 13.6 | 13.0 | 12.8 | 1.17 |
| D (Inv.) | 101 | 95 | 97 | 13.0 | 12.7 | 12.5 | 1.38 |
| E (Inv.) | 102 | 96 | 96 | 13.1 | 12.7 | 12.5 | 1.39 |
| F (Inv.) | 101 | 100 | 100 | 13.1 | 13.0 | 12.9 | 1.39 |
| G (Inv.) | 103 | 102 | 101 | 13.3 | 13.2 | 13.0 | 1.42 |
| H (Inv.) | 100 | 95 | 97 | 13.0 | 12.8 | 12.6 | 1.42 |
| I (Inv.) | 101 | 98 | 98 | 13.1 | 12.7 | 12.6 | 1.40 |

As can be found from Samples D and I, the addition of the redox compounds broadens the halftone dot gradation compared with Samples C and B to which the redox compounds are not added. In the case where the formylhydrazine derivative is singly used, as in Sample A, processing stability is inferior. Containing the redox compounds and using two or more kinds of the hydrazine compounds of the present invention, as in the samples of the present invention, allows broad halftone dot gradation and processing stability at the same time.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a support having thereon at least one silver halide emulsion layer and containing (i) at least one hydrazine compound represented by Formula (I) in said emulsion layer or in another hydrophilic colloid layer, and (ii) at least one hydrazine compound represented by Formula (II) in said emulsion layer or another hydrophilic colloid layer:

$$R_1\text{-NHNHCHO} \qquad \text{(I)}$$

wherein $R_1$ represents an aliphatic group or an aromatic group;

$$R_1-\underset{\underset{A_1}{|}}{N}-\underset{\underset{A_2}{|}}{N}-G_1-R_2 \qquad \text{(II)}$$

wherein $R_1$ represents an aliphatic group or an aromatic group; R2 represents an alkoxyalkyl group or a phenoxyalkyl group; $G_1$ represents —CO—, —$SO_2$—, —P(=O)$R_3$—, —C(=O)C(=O)—, a thiocarbonyl group, or an iminomethylene group; both $A_1$ and $A_2$ represent a hydrogen atom, or one of them represents a hydrogen atom and the other represents an alkylsulfonyl group, an arylsulfonyl group, or an acyl group; and $R_3$ represents an alkyl group, an aryl group, an alkoxy group, an aryloxy group, an amino group, a hydrazino group, or a hydrogen atom, and $R_3$ may be the same as or different from $R_2$.

2. The light-sensitive material of claim 1, wherein the hydrazine compound represented by Formula (I) is present in an amount of $1\times10^{-6}$ to $5\times10^{-2}$ mole/mole of Ag; and the hydrazine compound represented by Formula (II) is present in an amount of $1\times10^{-6}$ to $5\times10^{-2}$ mole/mole of Ag.

3. The light-sensitive material of claim 1, wherein the hydrazine compound represented by Formula (I) and the hydrazine compound represented by Formula (II) are present in a mole ratio of 20:1 to 1:20.

4. The light-sensitive material of claim 3, wherein the above mole ratio is 1:5 to 5:1.

5. The light-sensitive material of claim 3, wherein the above mole ratio is 1:2 to 2:1.

6. The light-sensitive material of claim 1, wherein $R_2$ in Formula (II) is an alkoxyalkyl group.

7. The light-sensitive material of claim 1, wherein $R_2$ in Formula (II) is an phenoxyalkyl group.

8. A silver halide photographic light-sensitive material comprising a support having thereon (i) at least one light-sensitive silver halide emulsion layer containing at least one hydrazine compound represented by Formula (I), and (ii) a hydrophilic colloid layer containing a redox compound capable of releasing a development inhibitor by oxidation, the hydrophilic colloid layer being different from said light-sensitive silver halide emulsion layer, wherein the light-sensitive material further comprises at least one hydrazine compound represented by Formula (II) in said emulsion layer or in another hydrophilic colloid layer:

$$R_1\text{-NHNHCHO} \qquad \text{(I)}$$

wherein $R_1$ represents an aliphatic group or an aromatic group;

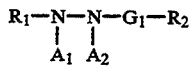

(II)

wherein $R_1$ represents an aliphatic group or an aromatic group; $R_2$ represents an alkoxyalkyl group or a phenoxyalkyl group; $G_1$ represents —CO—, —$SO_2$, —SO—, —P(=O)$R_3$—, —C(=O)C(=O)—, a thiocarbonyl group, or an iminomethylene group; both $A_1$ and $A_2$ represent a hydrogen atom, or one of them represents a hydrogen atom and the other represents an alkylsulfonyl group, an arylsulfonyl group, or an acyl group; and $R_3$ represents an alkyl group, an aryl group, an alkoxy group, an aryloxy group, an amino group, a hydrazino group, or a hydrogen atom and may be the same as or different from $R_2$.

9. The light-sensitive material of claim 8, wherein the redox compound is represented by Formula (R-1), Formula (R-2) or Formula (R-3):

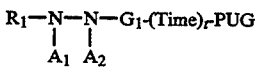

(R-1)

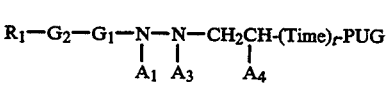

(R-2)

-continued

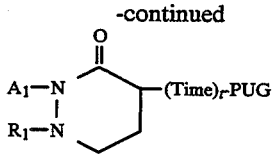

(R-3)

wherein $R_1$ represents an aliphatic group or an aromatic group; $G_1$ represents —CO—, —COCO—, —CS—, —C(=N$G_2R_2$)—, —SO—, —$SO_2$—, or —P(O)($G_2R_2$)—; $G_2$ represents a mere bond, —O—, —S— or —N($R_2$)—; $R_2$ represents the same group as that defined for $R_1$ or a hydrogen atom and in the case where a plurality of $R_2$ groups is present in the redox compound, they may be the same or different; $A_1$ and $A_2$ each represents a hydrogen atom, an alkylsulfonyl group, an arylsulfonyl group, or an acyl group; in Formula (R-1), at least one of $A_1$ and $A_2$ is a hydrogen atom; $A_3$ is synonymous with $A_1$ or represents —$CH_2CH(A_4)$-(Time)$_t$—PUG; $A_4$ represents a nitro group, a cyano group, a carboxyl group, a sulfonyl group, or —$G_1$—$G_2$—$R_1$ (in this case, two —$G_1$—$G_2$—$R_1$ groups in the redox compound may be the same or different); Time represents a divalent linkage group; t represents 0 or 1; and PUG represents a development inhibitor.

10. The light-sensitive material of claim 8, wherein the redox compound is present in an amount of $1\times10^{-6}$ to $5\times10^{-2}$ mole/mole of silver halide.

11. The light-sensitive material of claim 9, wherein the redox compound is represented by Formula (R-1).

12. The light-sensitive material of claim 9, wherein the redox compound is represented by Formula (R-2).

13. The light-sensitive material of claim 9, wherein the redox compound is represented by Formula (R-3).

* * * * *